US008261632B2

(12) United States Patent
Stevens

(10) Patent No.: US 8,261,632 B2
(45) Date of Patent: Sep. 11, 2012

(54) METHODS OF FORMING EARTH-BORING DRILL BITS

(75) Inventor: John H. Stevens, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 96 days.

(21) Appl. No.: 12/169,820

(22) Filed: Jul. 9, 2008

(65) Prior Publication Data

US 2010/0006345 A1 Jan. 14, 2010

(51) Int. Cl.
*B21K 5/04* (2006.01)

(52) U.S. Cl. ..... 76/108.4

(58) Field of Classification Search ..... 76/108.1–108.6; 419/5–8, 10, 12–14, 18, 28, 42, 47; 175/347, 175/425, 412, 413
See application file for complete search history.

(56) References Cited

U.S. PATENT DOCUMENTS

| | | | | |
|---|---|---|---|---|
| 1,557,743 | A | 10/1925 | Terrill | |
| 1,954,166 | A | 4/1934 | Campbell | |
| 2,299,207 | A | 10/1942 | Bevillard | |
| 2,507,439 | A | 5/1950 | Goolsbee | |
| 2,604,305 | A | 7/1952 | Livingstone | |
| 2,612,443 | A | 9/1952 | Goetzel et al. | |
| 2,819,959 | A | 1/1958 | Abkowitz et al. | |
| 2,843,501 | A | 7/1958 | Ellis et al. | |
| 2,861,779 | A | 11/1958 | White | |
| 2,906,654 | A | 9/1959 | Abkowitz | |
| 3,106,973 | A | 10/1963 | Christensen | |
| 3,326,308 | A * | 6/1967 | White | 175/413 |
| 3,336,992 | A * | 8/1967 | White | 175/412 |
| 3,368,881 | A | 2/1968 | Abkowitz et al. | |
| 3,463,256 | A | 8/1969 | White | |
| 3,469,976 | A * | 9/1969 | Iler | 419/18 |
| 3,471,921 | A | 10/1969 | Feenstra | |
| 3,545,554 | A | 12/1970 | Bardwell | |
| 3,660,050 | A | 5/1972 | Iler et al. | |
| 3,672,455 | A | 6/1972 | Foster, Jr. | |
| 3,757,878 | A | 9/1973 | Wilder et al. | |
| 3,757,879 | A | 9/1973 | Wilder et al. | |
| 3,823,002 | A | 7/1974 | Kirby, Jr. et al. | |
| 3,880,971 | A | 4/1975 | Pantanelli | |

(Continued)

FOREIGN PATENT DOCUMENTS

| | | |
|---|---|---|
| AU | 695583 | 2/1998 |

(Continued)

OTHER PUBLICATIONS

International Search Report and Written Opinion for PCT/US2007/023275, mailed Apr. 11, 2008.
International Preliminary Report on Patentability for PCT/US2007/023275, dated May 12, 2009.
International Search Report for International Application No. PCT/US2009/046812 dated Jan. 26, 2010 5 pages.

(Continued)

*Primary Examiner* — Jason Daniel Prone
(74) *Attorney, Agent, or Firm* — TraskBritt

(57) ABSTRACT

Methods of forming bit bodies for earth-boring bits include assembling and sintering infiltrated green components, infiltrated brown components, or infiltrated fully sintered components. Other methods include isostatically pressing a powder to form a green body substantially composed of a particle-matrix composite material, and sintering or hot isostatic pressing the green body or brown body to provide a bit body having a desired final density. Methods of forming earth-boring bits include providing a bit body substantially formed of a particle-matrix composite material and attaching a shank to the body. The body is provided by pressing a powder to form a green body and sintering the green body.

19 Claims, 18 Drawing Sheets

U.S. PATENT DOCUMENTS 3,987,859 A 10/1976 Lichte
4,017,480 A 4/1977 Baum
4,026,372 A 5/1977 Hampson
4,047,828 A 9/1977 Makely
4,094,709 A 6/1978 Rozmus
4,128,136 A 12/1978 Generoux
4,134,759 A 1/1979 Yajima et al.
4,157,122 A 6/1979 Morris
4,197,118 A 4/1980 Wiech, Jr.
4,198,233 A 4/1980 Frehn
4,221,270 A 9/1980 Vezirian
4,229,638 A 10/1980 Lichte
4,233,720 A 11/1980 Rozmus
4,244,432 A * 1/1981 Rowley et al. ..... 175/428
4,252,202 A 2/1981 Purser, Sr.
4,255,165 A 3/1981 Dennis et al.
4,306,139 A 12/1981 Shinozaki et al.
4,314,399 A 2/1982 Severinsson
4,327,156 A 4/1982 Dillon et al.
4,341,557 A 7/1982 Lizenby
4,389,952 A 6/1983 Dreier et al.
4,398,952 A 8/1983 Drake
4,431,449 A 2/1984 Dillon et al.
4,448,747 A * 5/1984 Moritoki et al. ..... 419/49
4,453,605 A 6/1984 Short, Jr.
4,455,354 A 6/1984 Dillon et al.
4,484,644 A 11/1984 Cook et al.
4,491,558 A 1/1985 Gardner
4,499,048 A 2/1985 Hanejko
4,499,795 A 2/1985 Radtke
4,499,958 A 2/1985 Radtke et al.
4,503,009 A 3/1985 Asaka
4,526,748 A 7/1985 Rozmus
4,538,928 A 9/1985 Muma
4,547,337 A 10/1985 Rozmus
4,552,232 A 11/1985 Frear
4,554,130 A 11/1985 Ecer
4,554,218 A 11/1985 Gardner et al.
4,562,990 A 1/1986 Rose
4,596,694 A 6/1986 Rozmus
4,597,730 A 7/1986 Rozmus
4,620,600 A 11/1986 Persson
4,630,693 A 12/1986 Goodfellow
4,656,002 A 4/1987 Lizenby et al.
4,667,756 A 5/1987 King et al.
4,686,080 A 8/1987 Hara et al.
4,694,919 A 9/1987 Barr
4,710,223 A 12/1987 Matejczyk
4,733,735 A 3/1988 Barr et al.
4,738,322 A 4/1988 Hall et al.
4,743,515 A 5/1988 Fischer et al.
4,744,943 A 5/1988 Timm
4,774,211 A 9/1988 Hamilton et al.
4,809,903 A 3/1989 Eylon et al.
4,830,821 A 5/1989 Okutomi et al.
4,838,366 A 6/1989 Jones
4,858,706 A 8/1989 Lebourg
4,863,538 A 9/1989 Deckard
4,871,377 A 10/1989 Frushour
4,884,477 A 12/1989 Smith et al.
4,889,017 A 12/1989 Fuller et al.
4,919,013 A 4/1990 Smith et al.
4,923,512 A 5/1990 Timm et al.
4,956,012 A 9/1990 Jacobs et al.
4,968,348 A 11/1990 Abkowitz et al.
4,981,665 A 1/1991 Boecker et al.
4,991,671 A 2/1991 Pearce et al.
5,000,273 A 3/1991 Horton et al.
5,017,753 A 5/1991 Deckard
5,030,598 A 7/1991 Hsieh
5,032,352 A 7/1991 Meeks et al.
5,049,450 A 9/1991 Dorfman et al.
5,090,491 A 2/1992 Tibbits et al.
5,099,934 A 3/1992 Barr
5,101,692 A 4/1992 Simpson
5,132,143 A 7/1992 Deckard
5,150,636 A 9/1992 Hill
5,155,321 A 10/1992 Grube et al.
5,155,324 A 10/1992 Deckard et al.
5,156,697 A 10/1992 Bourell et al.
5,161,898 A 11/1992 Drake
5,182,170 A 1/1993 Marcus et al.
5,232,522 A 8/1993 Doktycz et al.
5,281,260 A 1/1994 Kumar et al.
5,286,685 A 2/1994 Schoennahl et al.
5,311,958 A 5/1994 Isbell et al.
5,322,139 A 6/1994 Rose et al.
5,333,699 A 8/1994 Thigpen et al.
5,348,806 A 9/1994 Kojo et al.
5,372,777 A 12/1994 Yang
5,373,907 A 12/1994 Weaver
5,433,280 A 7/1995 Smith
5,439,068 A 8/1995 Huffstutler et al.
5,443,337 A 8/1995 Katayama
5,453,242 A 9/1995 Knoess
5,455,000 A 10/1995 Seyferth et al.
5,467,669 A 11/1995 Stroud
5,479,997 A 1/1996 Scott et al.
5,482,670 A 1/1996 Hong
5,484,468 A 1/1996 Ostlund et al.
5,506,055 A 4/1996 Dorfman et al.
5,518,077 A 5/1996 Blackman et al.
5,541,006 A 7/1996 Conley
5,543,235 A 8/1996 Mirchandani et al.
5,544,550 A 8/1996 Smith
5,560,440 A 10/1996 Tibbitts
5,586,612 A 12/1996 Isbell et al.
5,593,474 A 1/1997 Keshavan et al.
5,611,251 A 3/1997 Katayama
5,612,264 A 3/1997 Nilsson et al.
5,624,002 A 4/1997 Huffstutler
5,641,251 A 6/1997 Leins et al.
5,641,921 A 6/1997 Dennis et al.
5,662,183 A 9/1997 Fang
5,666,864 A 9/1997 Tibbitts
5,677,042 A 10/1997 Massa et al.
5,679,445 A 10/1997 Massa et al.
5,697,046 A 12/1997 Conley
5,697,462 A 12/1997 Grimes et al.
5,710,969 A 1/1998 Newman
5,732,783 A 3/1998 Truax et al.
5,733,649 A 3/1998 Kelley et al.
5,733,664 A 3/1998 Kelley et al.
5,740,872 A 4/1998 Smith
5,753,160 A 5/1998 Takeuchi et al.
5,765,095 A 6/1998 Flak et al.
5,776,593 A 7/1998 Massa et al.
5,778,301 A 7/1998 Hong
5,789,686 A 8/1998 Massa et al.
5,792,403 A 8/1998 Massa et al.
5,806,934 A 9/1998 Massa et al.
5,829,539 A 11/1998 Newton et al.
5,830,256 A 11/1998 Northrop et al.
5,856,626 A 1/1999 Fischer et al.
5,865,571 A 2/1999 Tankala et al.
5,878,634 A 3/1999 Tibbitts
5,880,382 A 3/1999 Fang et al.
5,897,830 A 4/1999 Abkowitz et al.
5,904,212 A 5/1999 Arfele
5,947,214 A 9/1999 Tibbitts
5,957,006 A 9/1999 Smith
5,963,775 A 10/1999 Fang
5,967,248 A 10/1999 Drake et al.
5,980,602 A 11/1999 Carden
6,029,544 A 2/2000 Katayama
6,045,750 A 4/2000 Drake et al.
6,051,171 A 4/2000 Takeuchi et al.
6,063,333 A 5/2000 Dennis
6,068,070 A 5/2000 Scott
6,073,518 A 6/2000 Chow et al.
6,086,980 A 7/2000 Foster et al.
6,089,123 A 7/2000 Chow et al.
6,099,664 A 8/2000 Davies et al.
6,107,225 A 8/2000 Shobu et al.
6,148,936 A 11/2000 Evans et al.
6,200,514 B1 3/2001 Meister
6,209,420 B1 4/2001 Butcher et al.

| | | | | |
|---|---|---|---|---|
| 6,214,134 | B1 | 4/2001 | Eylon et al. | |
| 6,214,287 | B1 | 4/2001 | Waldenstrom | |
| 6,220,117 | B1 | 4/2001 | Butcher | |
| 6,227,188 | B1 | 5/2001 | Tankala et al. | |
| 6,228,139 | B1 | 5/2001 | Oskarsson | |
| 6,241,036 | B1 | 6/2001 | Lovato et al. | |
| 6,254,658 | B1 | 7/2001 | Taniuchi et al. | |
| 6,284,014 | B1 | 9/2001 | Carden | |
| 6,287,360 | B1 | 9/2001 | Kembaiyan et al. | |
| 6,290,438 | B1 | 9/2001 | Papajewski | |
| 6,293,986 | B1 | 9/2001 | Rodiger et al. | |
| 6,322,746 | B1 | 11/2001 | LaSalle et al. | |
| 6,348,110 | B1 | 2/2002 | Evans | |
| 6,375,706 | B2 | 4/2002 | Kembaiyan et al. | |
| 6,408,958 | B1 | 6/2002 | Isbell et al. | |
| 6,453,899 | B1 | 9/2002 | Tselesin | |
| 6,454,025 | B1 | 9/2002 | Runquist et al. | |
| 6,454,028 | B1 | 9/2002 | Evans | |
| 6,454,030 | B1 | 9/2002 | Findley et al. | |
| 6,458,471 | B2 | 10/2002 | Lovato et al. | |
| 6,474,425 | B1 | 11/2002 | Truax et al. | |
| 6,500,226 | B1 | 12/2002 | Dennis | |
| 6,511,265 | B1 | 1/2003 | Mirchandani et al. | |
| 6,536,543 | B2 * | 3/2003 | Meiners et al. | 175/431 |
| 6,576,182 | B1 | 6/2003 | Ravagni et al. | |
| 6,589,640 | B2 | 7/2003 | Griffin et al. | |
| 6,599,467 | B1 | 7/2003 | Yamaguchi et al. | |
| 6,607,693 | B1 | 8/2003 | Saito et al. | |
| 6,651,756 | B1 | 11/2003 | Costo, Jr. et al. | |
| 6,655,481 | B2 | 12/2003 | Findley et al. | |
| 6,685,880 | B2 | 2/2004 | Engstrom et al. | |
| 6,742,608 | B2 | 6/2004 | Murdoch | |
| 6,742,611 | B1 | 6/2004 | Illerhaus et al. | |
| 6,756,009 | B2 | 6/2004 | Sim et al. | |
| 6,766,870 | B2 | 7/2004 | Overstreet | |
| 6,782,958 | B2 * | 8/2004 | Liang et al. | 175/374 |
| 6,849,231 | B2 | 2/2005 | Kojima et al. | |
| 6,908,688 | B1 | 6/2005 | Majagi et al. | |
| 6,918,942 | B2 | 7/2005 | Hatta et al. | |
| 7,044,243 | B2 | 5/2006 | Kembaiyan et al. | |
| 7,048,081 | B2 | 5/2006 | Smith et al. | |
| 7,066,286 | B2 | 6/2006 | Nguyen et al. | |
| 7,250,069 | B2 | 7/2007 | Kembaiyan et al. | |
| 7,261,782 | B2 | 8/2007 | Hwang et al. | |
| 7,270,679 | B2 | 9/2007 | Istephanous et al. | |
| 2,819,958 | A1 | 2/2008 | Abkowitz et al. | |
| 7,373,997 | B2 * | 5/2008 | Kembaiyan et al. | 175/374 |
| 7,395,882 | B2 | 7/2008 | Oldham et al. | |
| 7,513,320 | B2 | 4/2009 | Mirchandani et al. | |
| 7,776,256 | B2 * | 8/2010 | Smith et al. | 419/6 |
| 7,802,495 | B2 * | 9/2010 | Oxford et al. | 76/108.2 |
| 7,807,099 | B2 | 10/2010 | Choe et al. | |
| 7,841,259 | B2 * | 11/2010 | Smith et al. | 76/108.2 |
| 8,007,714 | B2 * | 8/2011 | Mirchandani et al. | 419/10 |
| 2002/0004105 | A1 | 1/2002 | Kunze et al. | |
| 2003/0010409 | A1 | 1/2003 | Kunze et al. | |
| 2004/0007393 | A1 | 1/2004 | Griffin | |
| 2004/0013558 | A1 | 1/2004 | Kondoh et al. | |
| 2004/0196638 | A1 | 10/2004 | Lee et al. | |
| 2004/0245022 | A1 | 12/2004 | Izaguirre et al. | |
| 2004/0245024 | A1 | 12/2004 | Kembaiyan | |
| 2005/0008524 | A1 | 1/2005 | Testani | |
| 2005/0084407 | A1 | 4/2005 | Myrick | |
| 2005/0117984 | A1 | 6/2005 | Eason et al. | |
| 2005/0126334 | A1 | 6/2005 | Mirchandani | |
| 2005/0211475 | A1 | 9/2005 | Mirchandani et al. | |
| 2005/0247491 | A1 | 11/2005 | Mirchandani et al. | |
| 2005/0268746 | A1 | 12/2005 | Abkowitz et al. | |
| 2006/0016521 | A1 | 1/2006 | Hanusiak et al. | |
| 2006/0032677 | A1 | 2/2006 | Azar et al. | |
| 2006/0043648 | A1 | 3/2006 | Takeuchi et al. | |
| 2006/0057017 | A1 | 3/2006 | Woodfield et al. | |
| 2006/0131081 | A1 | 6/2006 | Mirchandani et al. | |
| 2006/0231293 | A1 | 10/2006 | Ladi et al. | |
| 2007/0042217 | A1 | 2/2007 | Fang et al. | |
| 2007/0102198 | A1 | 5/2007 | Oxford et al. | |
| 2007/0102199 | A1 | 5/2007 | Smith et al. | |
| 2007/0102200 | A1 | 5/2007 | Choe et al. | |
| 2007/0102202 | A1 | 5/2007 | Choe et al. | |
| 2008/0011519 | A1 | 1/2008 | Smith et al. | |
| 2008/0053709 | A1 | 3/2008 | Lockstedt et al. | |
| 2008/0135305 | A1 | 6/2008 | Smith et al. | |
| 2008/0197692 | A1 * | 8/2008 | Hall et al. | 299/107 |
| 2008/0202814 | A1 | 8/2008 | Lyons et al. | |
| 2008/0264697 | A1 * | 10/2008 | Hall et al. | 175/432 |
| 2009/0031863 | A1 | 2/2009 | Lyons et al. | |
| 2009/0044663 | A1 | 2/2009 | Stevens et al. | |
| 2009/0301788 | A1 * | 12/2009 | Stevens et al. | 76/108.2 |
| 2010/0193252 | A1 * | 8/2010 | Mirchandani et al. | 175/425 |
| 2010/0319492 | A1 * | 12/2010 | Smith et al. | 76/108.4 |
| 2010/0326739 | A1 * | 12/2010 | Choe et al. | 175/426 |
| 2011/0094341 | A1 * | 4/2011 | Choe et al. | 76/108.2 |
| 2011/0142707 | A1 * | 6/2011 | Choe et al. | 419/17 |
| 2011/0186261 | A1 * | 8/2011 | Choe et al. | 164/76.1 |
| 2012/0097456 | A1 * | 4/2012 | Mirchandani et al. | 175/374 |

FOREIGN PATENT DOCUMENTS

| | | | |
|---|---|---|---|
| CA | 2212197 | | 10/2000 |
| DE | 10227403 | B3 * | 3/2004 |
| EP | 0264674 | A2 | 4/1988 |
| EP | 0453428 | A1 | 10/1991 |
| EP | 0995876 | A2 | 4/2000 |
| EP | 0930949 | B1 | 4/2001 |
| EP | 1244531 | B1 | 10/2002 |
| GB | 945227 | A | 12/1963 |
| GB | 2017153 | | 10/1979 |
| GB | 2203774 | | 10/1988 |
| GB | 2385350 | A | 8/2003 |
| GB | 2393449 | A | 3/2004 |
| JP | 10219385 | A | 8/1998 |
| WO | 9813159 | A1 | 4/1998 |
| WO | 03049889 | A2 | 6/2003 |
| WO | 2004053197 | A2 | 6/2004 |
| WO | 2007058904 | A1 | 5/2007 |
| WO | 2007058905 | A1 | 5/2007 |
| WO | 2008073308 | A2 | 6/2008 |

OTHER PUBLICATIONS

International Written Opinion for International Application No. PCT/US2009/046812 dated Jan. 26, 2010 5 pages.

Australian Patent Office Search Report and Written Opinion for Singapore Application No. 200803841-6, Feb. 15, 2010, 7 pages.

"Boron Carbide Nozzles and Inserts," Seven Stars International webpage http://www.concentric.net/~ctkang/nozzle.shtml, printed Sep. 7, 2006.

Alman, D.E., et al., "The Abrasive Wear of Sintered Titanium Matrix-Ceramic Particle Reinforced Composites," WEAR, 225-229 (1999), pp. 629-639.

Choe, Heeman, et al., "Effect of Tungsten Additions on the Mechanical Properties of Ti-6A1-4V," Material Science and Engineering, A 396 (2005), pp. 99-106, Elsevier.

Diamond Innovations, "Composite Diamond Coatings, Superhard Protection of Wear Parts New Coating and Service Parts from Diamond Innovations" brochure, 2004.

Gale, W.F., et al., Smithells Metals Reference Book, Eighth Edition, 2003, p. 2,117, Elsevier Butterworth Heinemann.

Miserez, A., et al. "Particle Reinforced Metals of High Ceramic Content," Material Science and Engineering A 387-389 (2004), pp. 822-831, Elsevier.

PCT International Search Report and Written Opinion of the International Search Authority for PCT Counterpart Application No. PCT/US2006/043669, mailed Apr. 13, 2007.

PCT International Search Report and Written Opinion of the International Search Authority for PCT Counterpart Application No. PCT/US2006/043670, mailed Apr. 2, 2007.

Reed, James S., "Chapter 13: Particle Packing Characteristics," Principles of Ceramics Processing, Second Edition, John Wiley & Sons, Inc. (1995), pp. 215-227.

U.S. Appl. No. 60/566,063, filed Apr. 28, 2004, entitled "Body Materials for Earth Boring Bits" to Mirchandani et al.

Warrier, S.G., et al., "Infiltration of Titanium Alloy-Matrix Composites," Journal of Materials Science Letters, 12 (1993), pp. 865-868, Chapman & Hall.

US 4,966,627, 10/1990, Keshavan et al. (withdrawn)

* cited by examiner

METHODS OF FORMING EARTH-BORING DRILL BITS

CROSS-REFERENCE TO RELATED APPLICATIONS

This application is related to U.S. patent application Ser. No. 11/271,153, filed on Nov. 10, 2005, now U.S. Pat. No. 7,802,495, issued Sep. 28, 2010 in the name of James A. Oxford, Jimmy W. Eason, Redd H. Smith, John H. Stevens, and Nicholas J. Lyons, and entitled "Earth-Boring Rotary Drill Bits And Methods Of Forming Earth-Boring Rotary Drill Bits," assigned to the assignee of the present application, and U.S. patent application Ser. No. 11/272,439, filed on Nov. 10, 2005, now U.S. Pat. No. 7,776,256, issued Aug. 17, 2010, in the name of Redd H. Smith, John H. Stevens, James L. Duggan, Nicholas J. Lyons, Jimmy W. Eason, Jared D. Gladney, James A. Oxford, and Benjamin J. Chrest, and entitled "Earth-Boring Rotary Drill Bits and Methods of Manufacturing Earth-Boring Rotary Drill Bits Having Particle-Matrix Composite Bit Bodies", assigned to the assignee of the present application, each of which is hereby incorporated by reference. This application is also related to U.S. patent application Ser. No. 12/831,608, filed Jul. 7, 2010 and entitled "Methods of Forming Earth-Boring Rotary Drill Bits," and U.S. patent application Ser. No. 12/827,968, filed Jun. 30, 2010 and entitled "Earth Boring Rotary Drill Bits and Methods of Manufacturing Earth Boring Rotary Drill Bits Having Particle Matrix Composite Bit Bodies."

BACKGROUND OF THE INVENTION

1. Field of the Invention

The present invention generally relates to earth-boring rotary drill bits, and to methods of manufacturing such earth-boring rotary drill bits. More particularly, the present invention generally relates to earth-boring rotary drill bits that include a bit body substantially formed of a particle-matrix composite material, and to methods of manufacturing such earth-boring drill bits.

2. State of the Art

Rotary drill bits are commonly used for drilling bore holes or wells in earth formations. Rotary drill bits include two primary configurations. One configuration is the roller cone bit, which typically includes three roller cones mounted on support legs that extend from a bit body. Each roller cone is configured to spin or rotate on a support leg. Cutting teeth typically are provided on the outer surfaces of each roller cone for cutting rock and other earth formations. The cutting teeth often are coated with an abrasive hard ("hardfacing") material. Such materials often include tungsten carbide particles dispersed throughout a metal alloy matrix material. Alternatively, receptacles are provided on the outer surfaces of each roller cone into which hardmetal inserts are secured to form the cutting elements. The roller cone drill bit may be placed in a bore hole such that the roller cones are adjacent the earth formation to be drilled. As the drill bit is rotated, the roller cones roll across the surface of the formation, the cutting teeth crushing the underlying formation.

A second configuration of a rotary drill bit is the fixed-cutter bit (often referred to as a "drag" bit), which typically includes a plurality of cutting elements secured to a face region of a bit body. Generally, the cutting elements of a fixed-cutter type drill bit have either a disk shape or a substantially cylindrical shape. A hard, super-abrasive material, such as mutually bonded particles of polycrystalline diamond, may be provided on a substantially circular end surface of each cutting element to provide a cutting surface. Such cutting elements are often referred to as "polycrystalline diamond compact" (PDC) cutters. Typically, the cutting elements are fabricated separately from the bit body and secured within pockets formed in the outer surface of the bit body. A bonding material such as an adhesive or, more typically, a braze alloy may be used to secure the cutting elements to the bit body. The fixed-cutter drill bit may be placed in a bore hole such that the cutting elements are adjacent the earth formation to be drilled. As the drill bit is rotated, the cutting elements scrape across and shear away the surface of the underlying formation.

The bit body of a rotary drill bit typically is secured to a hardened steel shank having an American Petroleum Institute (API) threaded pin for attaching the drill bit to a drill string. The drill string includes tubular pipe and equipment segments coupled end-to-end between the drill bit and other drilling equipment at the surface. Equipment such as a rotary table or top drive may be used for rotating the drill string and the drill bit within the bore hole. Alternatively, the shank of the drill bit may be coupled directly to the drive shaft of a down-hole motor, which then may be used to rotate the drill bit.

The bit body of a rotary drill bit may be formed from steel. Alternatively, the bit body may be formed from a particle-matrix composite material. Such materials include hard particles randomly dispersed throughout a matrix material (often referred to as a "binder" material). Such bit bodies typically are formed by embedding a steel blank in a carbide particulate material volume, such as particles of tungsten carbide, and infiltrating the particulate carbide material with a matrix material, such as a copper alloy. Drill bits that have a bit body formed from such a particle-matrix composite material may exhibit increased erosion and wear resistance, but lower strength and toughness relative to drill bits having steel bit bodies.

A conventional earth-boring rotary drill bit 10 that has a bit body including a particle-matrix composite material is illustrated in FIG. 1. As seen therein, the drill bit 10 includes a bit body 12 that is secured to a steel shank 20. The bit body 12 includes a crown 14, and a steel blank 16 that is embedded in the crown 14. The crown 14 includes a particle-matrix composite material such as, for example, particles of tungsten carbide embedded in a copper alloy matrix material. The bit body 12 is secured to the steel shank 20 by way of a threaded connection 22 and a weld 24 that extends around the drill bit 10 on an exterior surface thereof along an interface between the bit body 12 and the steel shank 20. The steel shank 20 includes an API threaded pin 28 for attaching the drill bit 10 to a drill string (not shown).

The bit body 12 includes wings or blades 30, which are separated by junk slots 32. Internal fluid passageways 42 extend between the face 18 of the bit body 12 and a longitudinal bore 40, which extends through the steel shank 20 and partially through the bit body 12. Nozzle inserts (not shown) may be provided at face 18 of the bit body 12 within the internal fluid passageways 42.

A plurality of PDC cutters 34 is provided on the face 18 of the bit body 12. The PDC cutters 34 may be provided along the blades 30 within pockets 36 formed in the face 18 of the bit body 12, and may be supported from behind by buttresses 38, which may be integrally formed with the crown 14 of the bit body 12.

The steel blank 16 shown in FIG. 1 is generally cylindrically tubular. Alternatively, the steel blank 16 may have a fairly complex configuration and may include external protrusions corresponding to blades 30 or other features extending on the face 18 of the bit body 12.

During drilling operations, the drill bit 10 is positioned at the bottom of a well bore hole and rotated while drilling fluid is pumped to the face 18 of the bit body 12 through the longitudinal bore 40 and the internal fluid passageways 42. As the PDC cutters 34 shear or scrape away the underlying earth formation, the formation cuttings and detritus are mixed with and suspended within the drilling fluid, which passes through the junk slots 32 and the annular space between the well bore hole and the drill string to the surface of the earth formation.

Conventionally, bit bodies that include a particle-matrix composite material, such as the previously described bit body 12, have been fabricated by infiltrating hard particles with molten matrix material in graphite molds. The cavities of the graphite molds are conventionally machined with a five-axis machine tool. Fine features are then added to the cavity of the graphite mold by hand-held tools. Additional clay work also may be required to obtain the desired configuration of some features of the bit body. Where necessary, preform elements or displacements (which may comprise ceramic components, graphite components, or resin-coated sand compact components) may be positioned within the mold and used to define the internal fluid passageways 42, cutter pockets 36, junk slots 32, and other external topographic features of the bit body 12. The cavity of the graphite mold is filled with hard particulate carbide material (such as tungsten carbide, titanium carbide, tantalum carbide, etc.). The preformed steel blank 16 may then be positioned in the mold at the appropriate location and orientation. The steel blank 16 typically is at least partially submerged in the particulate carbide material within the mold.

The mold then may be vibrated, or the particles otherwise packed, to decrease the amount of space between adjacent particles of the particulate carbide material. A matrix material, such as a copper-based alloy, may be melted, and the particulate carbide material may be infiltrated with the molten matrix material. The mold and bit body 12 are allowed to cool to solidify the matrix material. The steel blank 16 is bonded to the particle-matrix composite material, which forms the crown 14, upon cooling of the bit body 12 and solidification of the matrix material. Once the bit body 12 has cooled, the bit body 12 is removed from the mold and any displacements are removed from the bit body 12. Destruction of the graphite mold typically is required to remove the bit body 12.

As previously described, destruction of the graphite mold typically is required to remove the bit body 12. After the bit body 12 has been removed from the mold, the bit body 12 may be secured to the steel shank 20. As the particle-matrix composite material used to form the crown 14 is relatively hard and not easily machined, the steel blank 16 is used to secure the bit body 12 to the steel shank 20. Threads may be machined on an exposed surface of the steel blank 16 to provide the threaded connection 22 between the bit body 12 and the steel shank 20. The steel shank 20 may be screwed onto the bit body 12, and the weld 24 then may be provided along the interface between the bit body 12 and the steel shank 20.

The PDC cutters 34 may be bonded to the face 18 of the bit body 12 after the bit body 12 has been cast by, for example, brazing, mechanical affixation, or adhesive affixation. Alternatively, the PDC cutters 34 may be provided within the mold and bonded to the face 18 of the bit body 12 during infiltration or furnacing of the bit body 12 if thermally stable synthetic diamonds, or natural diamonds, are employed.

The molds used to cast bit bodies are difficult to machine due to their size, shape, and material composition. Furthermore, manual operations using hand-held tools are often required to form a mold and to form certain features in the bit body after removing the bit body from the mold, which further complicates the reproducibility of bit bodies. These facts, together with the fact that only one bit body can be cast using a single mold, complicate reproduction of multiple bit bodies having consistent dimensions. As a result, there may be variations in cutter placement in or on the face of the bit bodies. Due to these variations, the shape, strength, and ultimately the performance during drilling of each bit body may vary, which makes it difficult to ascertain the life expectancy of a given drill bit. As a result, the drill bits on a drill string are typically replaced more often than is desirable, in order to prevent unexpected drill bit failures, which results in additional costs.

As may be readily appreciated from the foregoing description, the process of fabricating a bit body that includes a particle-matrix composite material is a somewhat costly, complex, multi-step, labor-intensive process requiring separate fabrication of an intermediate product (the mold) before the end product (the bit body) can be cast. Moreover, the blanks, molds, and any preforms employed must be individually designed and fabricated. While bit bodies that include particle-matrix composite materials may offer significant advantages over prior art steel-body bits in terms of abrasion and erosion-resistance, the lower strength and toughness of such bit bodies prohibit their use in certain applications.

Therefore, it would be desirable to provide a method of manufacturing a bit body that includes a particle-matrix composite material that eliminates the need of a mold, and that provides a bit body of higher strength and toughness that can be easily attached to a shank or other component of a drill string.

Furthermore, the known methods for forming a bit body that includes a particle-matrix composite material require that the matrix material be heated to a temperature above the melting point of the matrix material. Certain materials that exhibit good physical properties for a matrix material are not suitable for use because of detrimental interactions between the particles and matrix, which may occur when the particles are infiltrated by the particular molten matrix material. As a result, a limited number of alloys are suitable for use as a matrix material. Therefore, it would be desirable to provide a method of manufacturing suitable for producing a bit body that includes a particle-matrix composite material that does not require infiltration of hard particles with a molten matrix material.

Additionally, when forming a bit body that includes particle-matrix composite material, during the sintering of the particle-matrix composite material forming the bit body, the bit body shrinks, making it difficult to maintain dimensional control of the bit body being formed. It would be desirable to provide a method of manufacturing a bit body that reduces the shrinkage of the bit body during the sintering of the particle-matrix composite material.

BRIEF SUMMARY OF THE INVENTION

In one aspect, the present invention includes a method of forming a bit body for an earth-boring drill bit. A plurality of green powder components are provided and assembled to form a green unitary structure. At least one green powder component is configured to form a region of a bit body. The green unitary structure has the binder substantially removed therefrom, infiltrated, and sintered to a final density. The green unitary structure is at least partially sintered, infiltrated after partial sintering, and sintered to a final density.

The features, advantages, and alternative aspects of the present invention will be apparent to those skilled in the art from a consideration of the following detailed description considered in combination with the accompanying drawings.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION OF THE INVENTION

The illustrations presented herein are not meant to be actual views of any particular material, apparatus, system, or method, but are merely idealized representations which are employed to describe the present invention. Additionally, elements common between figures may retain the same numerical designation.

The term "green" as used herein means unsintered.

The term "green bit body" as used herein means an unsintered structure comprising a plurality of discrete particles held together by a binder material, the structure having a size and shape allowing the formation of a bit body suitable for use in an earth-boring drill bit from the structure by subsequent manufacturing processes including, but not limited to, machining and densification.

The term "brown" as used herein means partially sintered.

The term "brown bit body" as used herein means a partially sintered structure comprising a plurality of particles, at least some of which have partially grown together to provide at least partial bonding between adjacent particles, the structure having a size and shape allowing the formation of a bit body suitable for use in an earth-boring drill bit from the structure by subsequent manufacturing processes including, but not limited to, machining and further densification. Brown bit bodies may be formed by, for example, partially sintering a green bit body.

The term "sintering" as used herein means densification of a particulate component involving removal of at least a portion of the pores between the starting particles (accompanied by shrinkage) combined with coalescence and bonding between adjacent particles.

As used herein, the term "[metal]-based alloy" (where [metal] is any metal) means commercially pure [metal] in addition to metal alloys wherein the weight percentage of [metal] in the alloy is greater than the weight percentage of any other component of the alloy.

As used herein, the term "material composition" means the chemical composition and microstructure of a material. In other words, materials having the same chemical composition but a different microstructure are considered to have different material compositions.

As used herein, the term "tungsten carbide" means any material composition that contains chemical compounds of tungsten and carbon, such as, for example, WC, $W_2C$, and combinations of WC and $W_2C$. Tungsten carbide includes, for example, cast tungsten carbide, sintered tungsten carbide, and macrocrystalline tungsten carbide.

Figure 1:
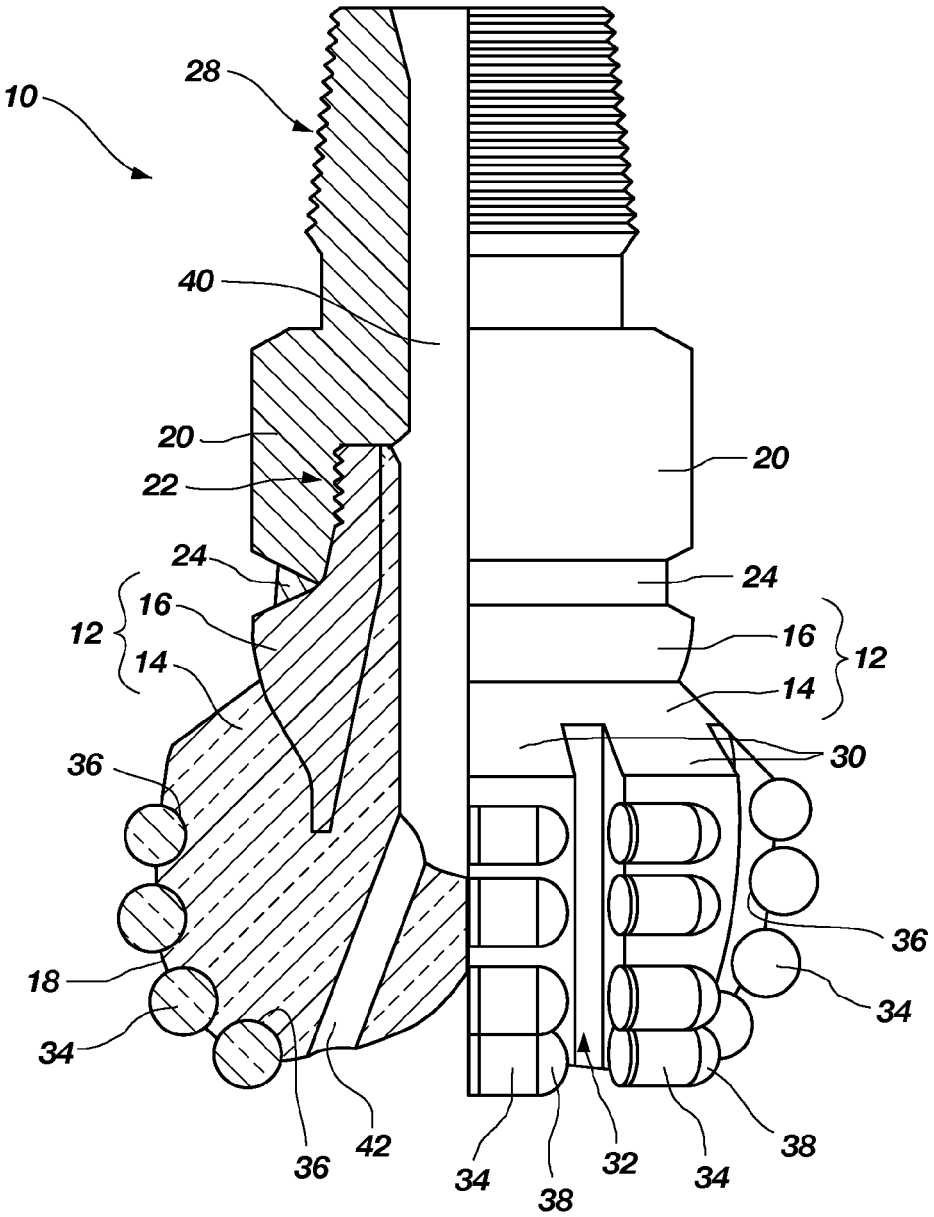
FIG. 1 (PRIOR ART)
FIG. 1 is a partial cross-sectional side view of a conventional earth-boring rotary drill bit having a bit body that includes a particle-matrix composite material.
Figure 2:
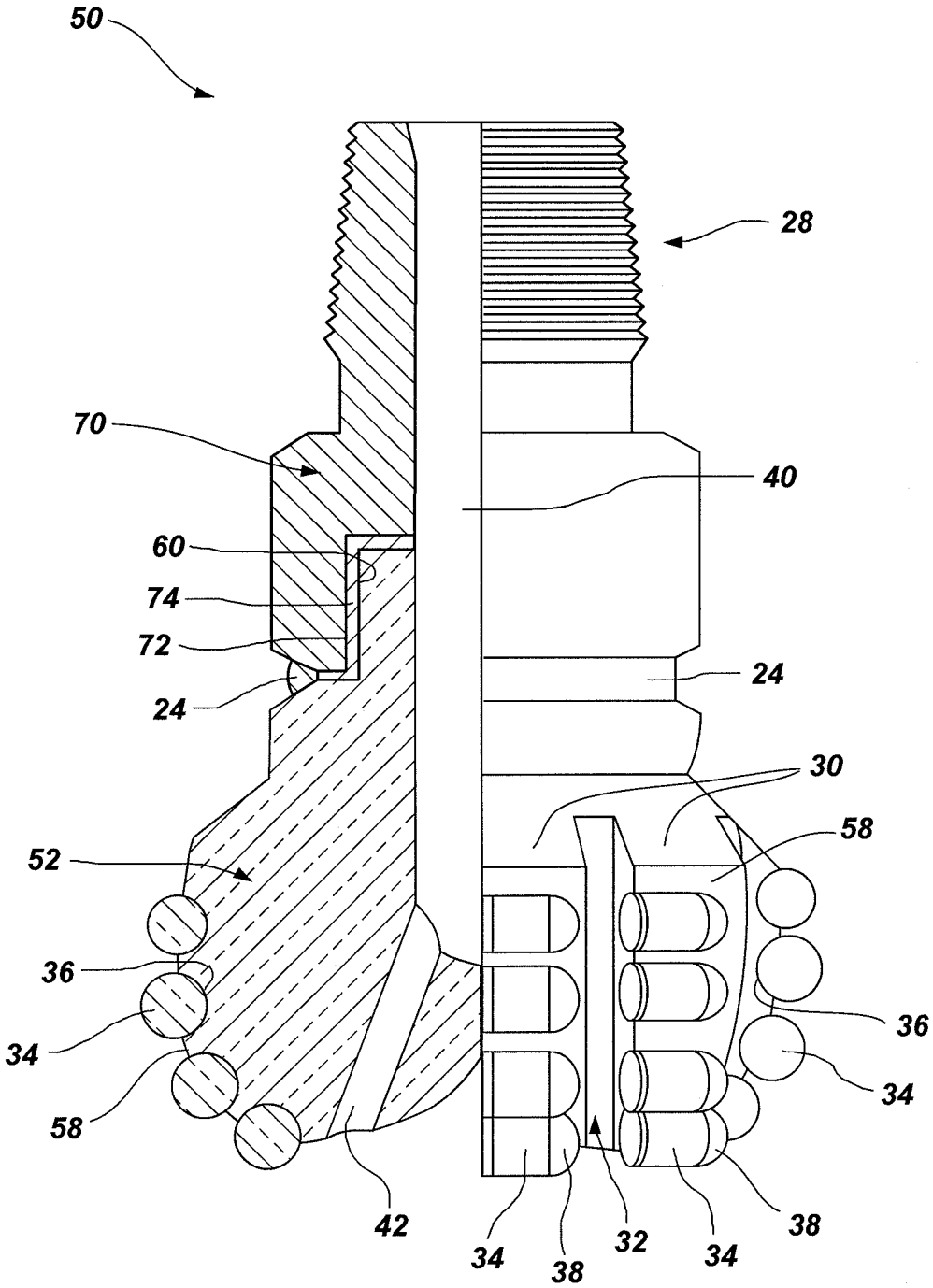
FIG. 2 is a partial cross-sectional side view of an earth-boring rotary drill bit that embodies teachings of the present invention and has a bit body that includes a particle-matrix composite material.

An earth-boring rotary drill bit 50 that embodies teachings of the present invention is shown in FIG. 2. The drill bit 50 includes a bit body 52 substantially formed from and composed of a particle-matrix composite material. The drill bit 50 also may include a shank 70 attached to the bit body 52. The bit body 52 does not include a steel blank integrally formed therewith for attaching the bit body 52 to the shank 70.

The bit body 52 includes blades 30, which are separated by junk slots 32. Internal fluid passageways 42 extend between the face 58 of the bit body 52 and a longitudinal bore 40, which extends through the shank 70 and partially through the bit body 52. The internal fluid passageways 42 may have a substantially linear, piece-wise linear, or curved configuration. Nozzle inserts or fluid ports (not shown) may be provided at face 58 of the bit body 52 within the internal fluid passageways 42. The nozzle inserts may be integrally formed with the bit body 52 and may include circular or noncircular cross sections at the openings at the face 58 of the bit body 52.

The drill bit 50 may include a plurality of PDC cutters 34 disposed on the face 58 of the bit body 52. The PDC cutters 34 may be provided along blades 30 within pockets 36 formed in the face 58 of the bit body 52, and may be supported from behind by buttresses 38, which may be integrally formed with the bit body 52. Alternatively, the drill bit 50 may include a plurality of cutters formed from an abrasive, wear-resistant material such as, for example, cemented tungsten carbide. Furthermore, the cutters may be integrally formed with the bit body 52, as will be discussed in further detail below.

The particle-matrix composite material of the bit body 52 may include a plurality of hard particles randomly dispersed throughout a matrix material. The hard particles may comprise diamond or ceramic materials such as carbides nitrides, oxides, and borides (including boron carbide ($B_4C$)). More specifically, the hard particles may comprise carbides and borides made from elements such as W, Ti, Mo, Nb, V, Hf, Ta, Cr, Zr, Al, and Si. By way of example and not limitation, materials that may be used to form hard particles include tungsten carbide, titanium carbide (TiC), tantalum carbide (TaC), titanium diboride ($TiB_2$), chromium carbides, titanium nitride (TiN), aluminium oxide ($Al_2O_3$), aluminium nitride (AlN), and silicon carbide (SiC). Furthermore, combinations of different hard particles may be used to tailor the physical properties and characteristics of the particle-matrix composite material. The hard particles may be formed using techniques known to those of ordinary skill in the art. Most suitable materials for hard particles are commercially available and the formation of the remainder is within the ability of one of ordinary skill in the art.

The matrix material of the particle-matrix composite material may include, for example, cobalt-based, iron-based, nickel-based, iron- and nickel-based, cobalt- and nickel-based, iron- and cobalt-based, aluminum-based, copper-based, magnesium-based, and titanium-based alloys. The matrix material may also be selected from commercially pure elements such as cobalt, aluminum, copper, magnesium, titanium, iron, and nickel. By way of example and not limitation, the matrix material may include carbon steel, alloy steel, stainless steel, tool steel, Hadfield manganese steel, nickel or cobalt superalloy material, and low thermal expansion iron- or nickel-based alloys such as INVAR®. As used herein, the term "superalloy" refers to iron-, nickel-, and cobalt-based alloys having at least 12% chromium by weight. Additional exemplary alloys that may be used as matrix material include austenitic steels, nickel-based superalloys such as INCONEL® 625M or Rene 95, and INVAR® type alloys having a coefficient of thermal expansion that closely matches that of the hard particles used in the particular particle-matrix composite material. More closely matching the coefficient of thermal expansion of matrix material with that of the hard particles offers advantages such as reducing problems associated with residual stresses and thermal fatigue. Another exemplary matrix material is a Hadfield austenitic manganese steel (Fe with approximately 12% Mn by weight and 1.1% C by weight).

In one embodiment of the present invention, the particle-matrix composite material may include a plurality of −400 ASTM (American Society for Testing and Materials) mesh tungsten carbide particles as the hard particle component of the particle-matrix composite material. For example, the tungsten carbide particles may be substantially composed of WC. As used herein, the phrase "−400 ASTM mesh particles" means particles that pass through an ASTM No. 400 mesh screen as defined in ASTM specification E11-04, entitled "Standard Specification for Wire Cloth and Sieves for Testing Purposes." Such tungsten carbide particles may have a diameter of less than about 38 microns. The matrix material forming another component of the particle-matrix composite material may include a metal alloy comprising about 50% cobalt by weight and about 50% nickel by weight. The tungsten carbide particles may comprise between about 60% and about 95% by weight of the particle-matrix composite material, and the matrix material may comprise between about 5% and about 40% by weight of the particle-matrix composite material. More particularly, the tungsten carbide particles may comprise between about 70% and about 80% by weight of the particle-matrix composite material, and the matrix material may comprise between about 20% and about 30% by weight of the particle-matrix composite material.

In another embodiment of the present invention, the particle-matrix composite material may include a plurality of −635 ASTM mesh tungsten carbide particles as the hard particle component of the particle-matrix composite material. As used herein, the phrase "−635 ASTM mesh particles" means particles that pass through an ASTM No. 635 mesh screen as defined in ASTM specification E11-04, entitled "Standard Specification for Wire Cloth and Sieves for Testing Purposes." Such tungsten carbide particles may have a diameter of less than about 20 microns. The matrix material may include a cobalt-based metal alloy comprising substantially commercially pure cobalt. For example, the matrix material forming another component of the particle-matrix composite material may include greater than about 98% cobalt by weight. The tungsten carbide particles may comprise between about 60% and about 95% by weight of the particle-matrix composite material, and the matrix material may comprise between about 5% and about 40% by weight of the particle-matrix composite material.

With continued reference to FIG. 2, the shank 70 includes an API threaded connection portion (e.g., a pin 28) for connecting the drill bit 50 to a drill string (not shown). The shank 70 may be formed from and composed of a material that is relatively tough and ductile relative to the bit body 52. By way of example and not limitation, the shank 70 may include a steel alloy.

As the particle-matrix composite material of the bit body 52 may be relatively wear-resistant and abrasive, machining of the bit body 52 may be difficult or impractical. As a result, conventional methods for attaching the shank 70 to the bit body 52, such as by machining cooperating positioning threads on mating surfaces of the bit body 52 and the shank 70, with subsequent formation of a weld 24, may not be feasible.

As an alternative to conventional methods for attaching the shank 70 to the bit body 52, the bit body 52 may be attached and secured to the shank 70 by brazing or soldering an interface between abutting surfaces of the bit body 52 and the shank 70. By way of example and not limitation, a brazing alloy 74 may be provided at an interface between a surface 60 of the bit body 52 and a surface 72 of the shank 70. Furthermore, the bit body 52 and the shank 70 may be sized and configured to provide a predetermined standoff between the surface 60 and the surface 72, in which the brazing alloy 74 may be provided.

Alternatively, the shank 70 may be attached to the bit body 52 using a weld 24 provided between the bit body 52 and the shank 70. The weld 24 may extend around the drill bit 50 on an exterior surface thereof along an interface between the bit body 52 and the shank 70.

In alternative embodiments, the bit body 52 and the shank 70 may be sized and configured to provide a press fit or a shrink fit between the surface 60 and the surface 72 to attach the shank 70 to the bit body 52.

Furthermore, interfering non-planar surface features may be formed on the surface 60 of the bit body 52 and the surface 72 of the shank 70. For example, threads or longitudinally extending splines, rods, or keys (not shown) may be provided in or on the surface 60 of the bit body 52 and the surface 72 of the shank 70 to prevent rotation of the bit body 52 relative to the shank 70.

FIGS. 3A-3I illustrate a method of forming the bit body 52 of FIG. 2, which is substantially formed firm and composed of a particle-matrix composite material. The method generally includes providing a powder mixture, pressing the powder mixture to form a green body, and at least partially sintering the powder mixture.

Figure 3A:
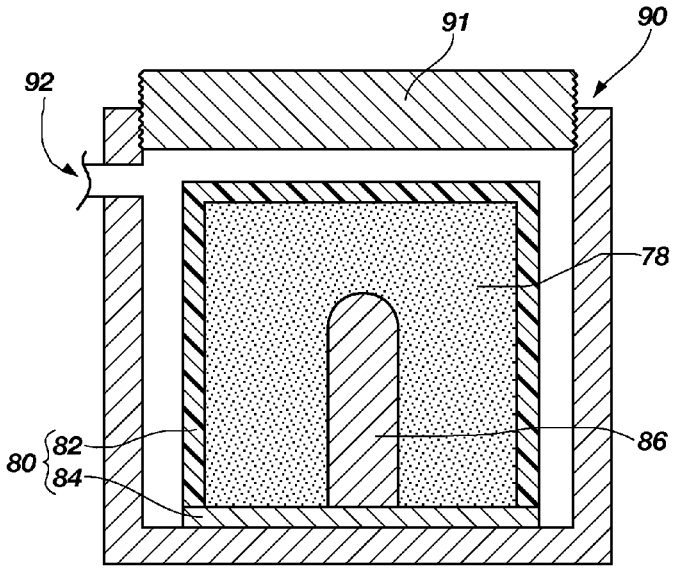
FIGS. 3A-3I illustrate a method of forming the bit body of the earth-boring rotary drill bit shown FIG. 2.

Referring to FIG. 3A, a powder mixture 78, which forms the particle-matrix composite material that includes a hard particle component and a matrix material component, may be pressed with substantially isostatic pressure within a mold or container 80. The powder mixture 78 may include a plurality of the previously described hard particles and a plurality of particles comprising a matrix material, as also previously described herein. Optionally, the powder mixture 78 may further include additives commonly used when pressing powder mixtures, such as, for example, binders for providing lubrication during pressing and for providing structural strength to the pressed powder component, plasticizers for making the binder more pliable, and lubricants or compaction aids for reducing inter-particle friction.

The container 80 may include a fluid-tight deformable member 82. For example, the fluid-tight deformable member 82 may be a substantially cylindrical bag comprising a deformable polymer material. The container 80 may further include a sealing plate 84, which may be substantially rigid.

The deformable member 82 may be formed from, for example, an elastomer such as rubber, neoprene, silicone, or polyurethane. The deform able member 82 may be filled with the powder mixture 78 and vibrated to provide a uniform distribution of the powder mixture 78 within the deformable member 82. At least one displacement or insert 86 may be provided within the deformable member 82 for defining features of the bit body 52, such as, for example, the longitudinal bore 40 (FIG. 2). Alternatively, the insert 86 may not be used and the longitudinal bore 40 may be formed using a conventional machining process during subsequent processes. The sealing plate 84 then may be attached or bonded to the deformable member 82 providing a fluid-tight seal therebetween.

The container 80 (with the powder mixture 78 and any desired inserts 86 contained therein) may be provided within a pressure chamber 90. A removable cover 91 may be used to provide access to the interior of the pressure chamber 90. A fluid (which may be substantially incompressible) such as, for example, water, oil, or gas (such as, for example, air or nitrogen) is pumped into the pressure chamber 90 through an opening 92 at high pressures using a pump (not shown). The high pressure of the fluid causes the walls of the deformable member 82 to deform. The fluid pressure may be transmitted substantially uniformly to the powder mixture 78. The pressure within the pressure chamber 90 during isostatic pressing may be greater than about 35 megapascals (about 5,000 pounds per square inch). More particularly, the pressure within the pressure chamber 90 during isostatic pressing may be greater than about 138 megapascals (20,000 pounds per square inch). In alternative methods, a vacuum may be provided within the container 80 and a pressure greater than about 0.1 megapascal (about 15 pounds per square inch) may be applied to the exterior surfaces of the container 80 (by, for example, the atmosphere) to compact the powder mixture 78. Isostatic pressing of the powder mixture 78 may form a green powder component or green bit body 94 shown in FIG. 3B, which can be removed from the pressure chamber 90 and container 80 after pressing.

Figure 3B:
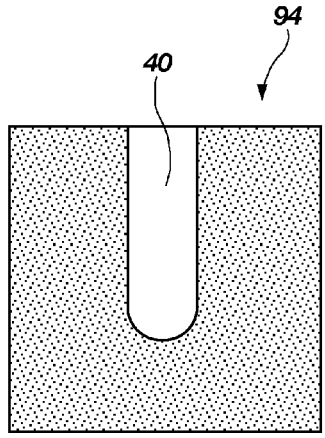

In an alternative method of pressing the powder mixture 78 to form the green bit body 94 shown in FIG. 3B, the powder mixture 78 may be uniaxially pressed in a mold or die (not shown) using a mechanically or hydraulically actuated plunger by methods that are known to those of ordinary skill in the art of powder processing.

The green bit body 94 shown in FIG. 3B may include a plurality of particles (hard particles and particles of matrix material forming the particle-matrix composite material) held together by a binder material provided in the powder mixture 78 (FIG. 3A), as previously described. Certain structural features may be machined in the green bit body 94 using conventional machining techniques including, for example, turning techniques, milling techniques, and drilling techniques. Hand held tools also may be used to manually form or shape features in or on the green bit body 94. By way of example and not limitation, blades 30, junk slots 32, and surface 60 (FIG. 2) may be machined or otherwise formed in the green bit body 94 to form a shaped green bit body 98 shown in FIG. 3C.

Figure 3C:
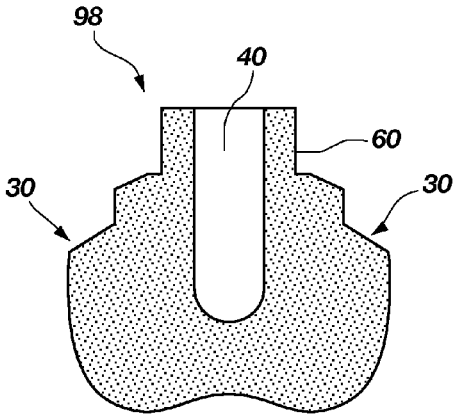
Figure 3D:
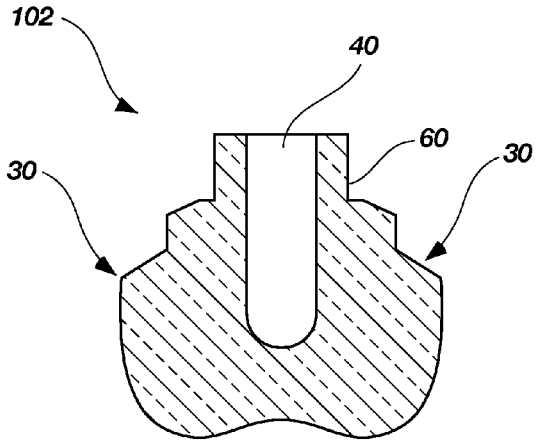

The shaped green bit body 98 shown in FIG. 3C may be at least partially sintered to provide a brown bit body 102 shown in FIG. 3D, which has less than a desired final density. Prior to partially sintering the shaped green bit body 98, the shaped green bit body 98 may be subjected to moderately elevated temperatures and pressures to burn off or remove any fugitive additives of any binder used that were included in the powder mixture 78 (FIG. 3A), as previously described. Furthermore, the shaped green bit body 98 may be subjected to a suitable atmosphere tailored to aid in the removal of such fugitive additives. Such atmospheres may include, for example, hydrogen gas at temperatures of about 250° C. to about 500° C.

The brown bit body 102 may be substantially machinable due to the remaining porosity therein. Certain structural features may be machined in the brown bit body 102 using conventional machining techniques including, for example, turning techniques, milling techniques, and drilling techniques. Hand held tools also may be used to manually form or shape features in or on the brown bit body 102. Tools that include super hard coatings or inserts may be used to facilitate machining of the brown bit body 102. Additionally, material coatings may be applied to surfaces of the brown bit body 102 that are to be machined to reduce chipping of the brown bit body 102. Such coatings may include a suitable fixative material or other suitable polymer materials or the like.

Figure 3E:
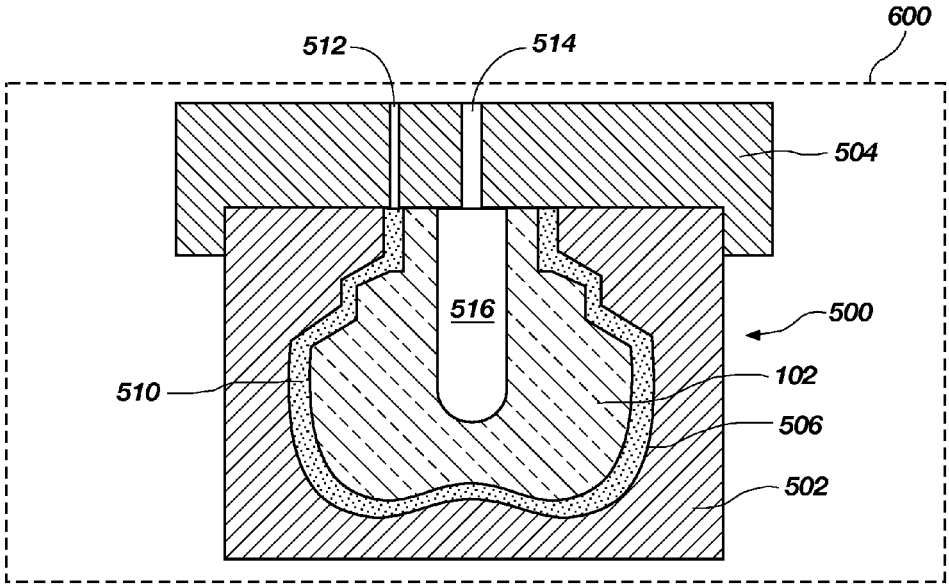
Figure 3F:
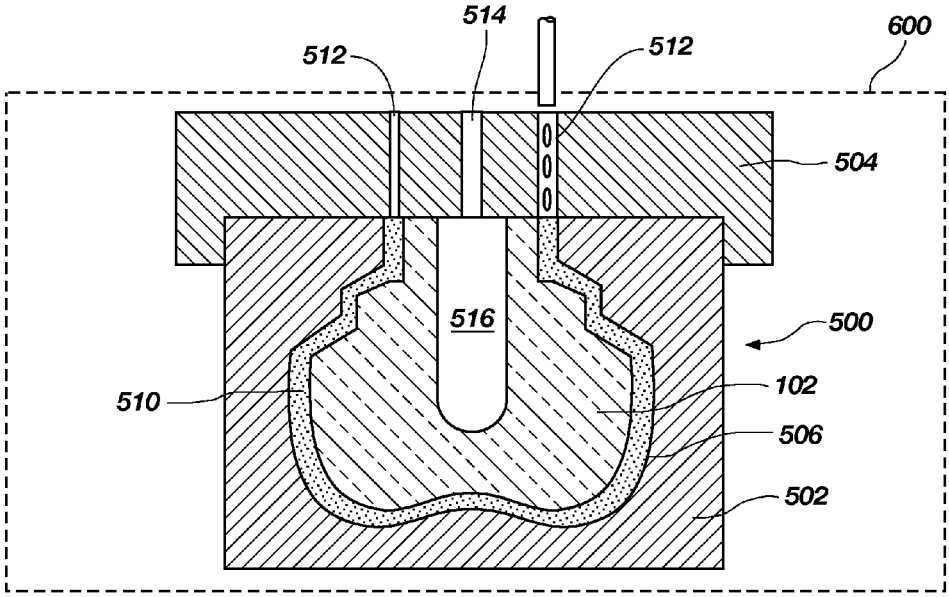
Figure 3G:
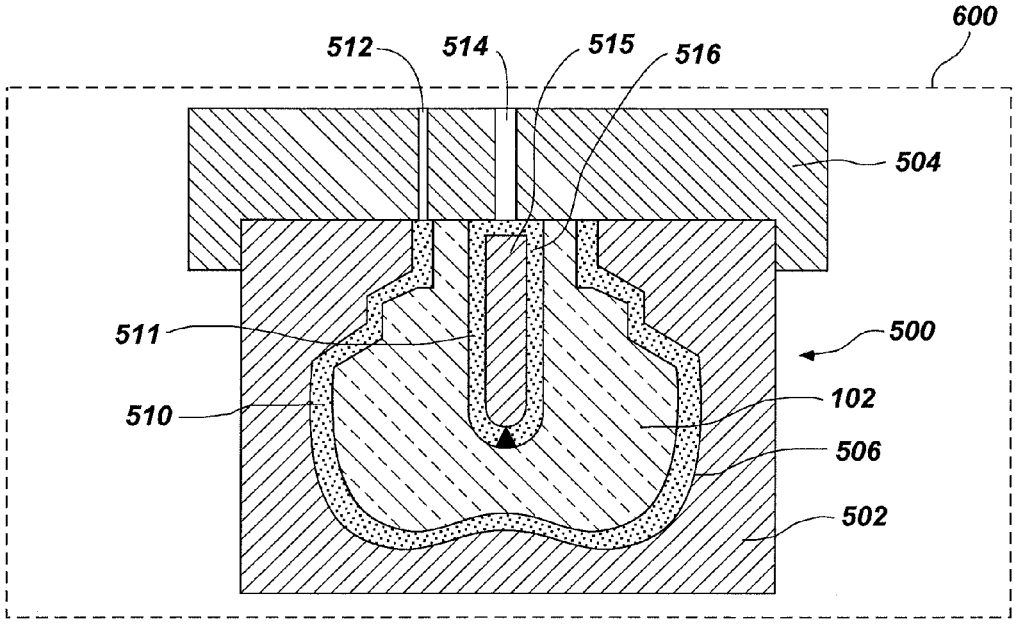
Figure 3H:
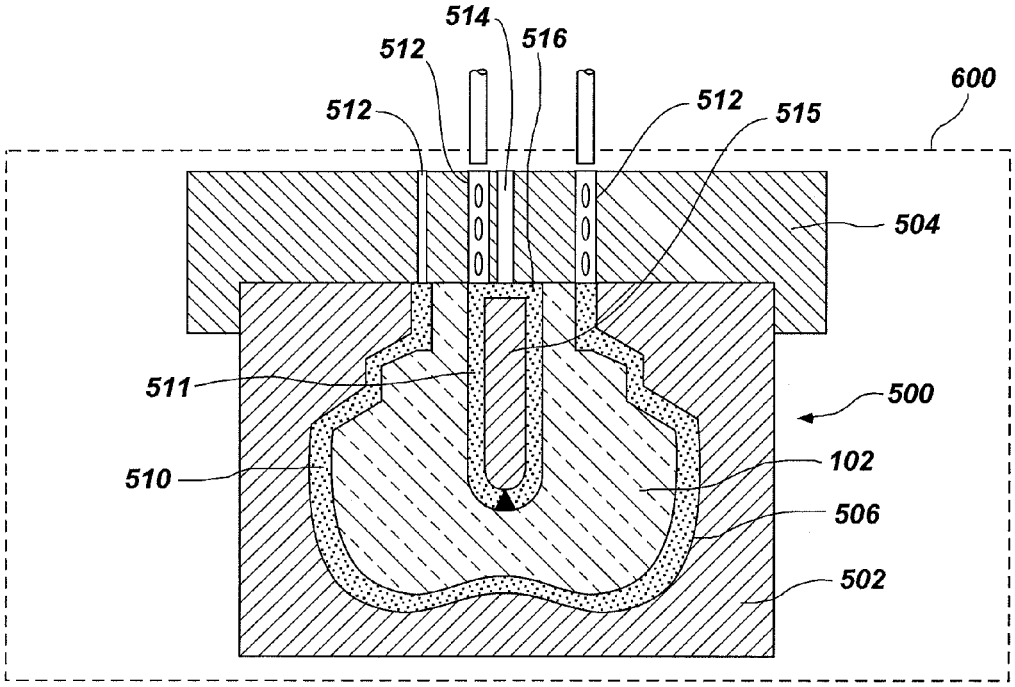
Figure 3I:
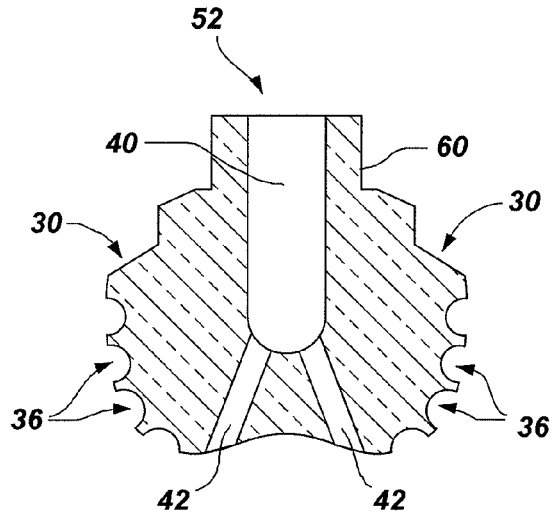

By way of example and not limitation, internal fluid passageways 42, cutter pockets 36, and buttresses 38 (FIG. 2) may be machined or otherwise formed in the brown bit body 102 to form a shaped brown bit body 106 shown in FIG. 3I. Furthermore, if the drill bit 50 is to include a plurality of cutters integrally formed with the bit body 52, the cutters may be positioned within the cutter pockets 36 formed in the brown bit body 102. Upon subsequent sintering of the brown bit body 102, the cutters may become bonded to and integrally formed with the bit body 52.

As any final sintering of the shaped brown bit body 106 will cause shrinkage thereof, the brown bit body 106 will be infiltrated with a suitable material before the final sintering of the brown bit body 106 to minimize the shrinkage thereof during final sintering. Controlling sintering of a complex shaped structure such as the brown bit body 106 to a final density of less than 100 percent requires the simultaneous control of the shrinkage of the bit body 106 and the porosity of the bit body 106. As sintering temperature and furnace environment are critical during final sintering of the bit body 106, the correct sintering time and temperature are determined empirically through sintering trials of bit bodies having different shapes and varying particle-matrix composite material. In general, the amount of shrinkage of a bit body during final shrinkage will vary with the porosity of the bit body caused by the particle size and distribution and amount of binder used, if any, for the formation of the green bit body.

Either a green bit body or a brown bit body may be infiltrated with a metal or metal alloy. However, if a green bit body is to be infiltrated with a metal or metal alloy, it is necessary to subject the green bit body to moderately elevated temperatures and pressures to burn off or remove any fugitive additive of any binder used that has been included in the power mixture 78 (FIG. 3A). For such fugitive binder removal from the green bit body, the body may be subjected to a suitable atmosphere tailored to remove such fugitive binder, such as a hydrogen gas at temperatures of about 250° C. to about 500° C. When either a green bit body or a brown bit body and the metal or metal alloy to be infiltrated therein are placed in close proximity at a high infiltration temperature, the metal or metal alloy melts, and is absorbed into either the green bit body or the brown bit body. The infiltration of any bit body or the brown bit body usually takes place in either a reducing atmosphere, such as hydrogen gas, or in a vacuum. After cooling of any bit body or the brown bit body, any excess metal used to infiltrate the brown bit body is removed therefrom using any suitable apparatus and method compatible with the infiltrated brown bit body. For convenience, the infiltration of a brown bit body will be described, which is applicable to the infiltration of a green bit body after the removal of any binder therefrom, as described herein.

The metal or metal alloy used to infiltrate the brown bit body has a melting temperature below the melting temperature of the particles of the matrix material of the particle-matrix composite material. Also, the metal or metal alloy is a solid at normal atmospheric temperature. The metal or metal alloy used to infiltrate the brown bit body must have suitable properties to "wet" the brown bit body during the infiltration process. The selection of the metal or metal alloy to be used to infiltrate the brown bit body will be based upon those metals or metal alloys having suitable characteristics to be compatible with the particle-matrix composite material formed by the hard particles and the particles of the matrix material. Wetting characteristics of the metal or metal alloy may be determined either empirically or by determining if the metal or metal alloy used as an infiltrant will wet the brown bit body according to the sessile drop test.

Suitable metal or metal alloys comprise copper or copper alloys, such as copper and nickel, copper and silver, and copper alloys used to infiltrate fixed cutter drill bit bodies. When in powder form, the size of the metal particles or metal alloy particles of the infiltrant may be similar to that of the particle size of the particles of the particle-matrix composite material to promote the melting of the metal particles or metal alloy particles. In other embodiments, however, the size and/or shape of the metal particles or metal alloy particles of the infiltrant may differ from that of the particle size of the particles of the particle-matrix composite material.

When the brown bit body is placed adjacent the metal or metal alloys used to infiltrate and heated above the melting point of the metal or metal alloy, the metal or metal alloy will melt and "wick" into the interior of the brown bit body. The time and temperature necessary to infiltrate the brown bit body will vary depending upon the choice of the metal or metal alloy, the rate of heating, the wetting characteristics of the metal or metal alloy, and the size of the pore-like passages or interstices within the brown bit body.

After being infiltrated, the brown bit body has substantially reduced porosity and a density near its theoretical density based on the densities of the metal or metal alloy and the particle-composite matrix material formed by the hard particles and particles of matrix materials. Essentially the only un-infiltrated space in the brown bit body is the closed porosity of the original brown bit body as the connected porosity of the brown bit body is substantially completely occupied by the metal or metal alloy used as an infiltrant.

In FIG. 3E, the shaped brown bit body 102 is illustrated placed in a mold 500 including a lower portion 502 and an upper portion 504. The lower portion 502 has an interior surface 506 which generally matches the topography of the brown bit body 102 therein. The mold 500 is typically machined from a cylindrical graphite element or formed from other heat-resistant material able to withstand the temperatures of an infiltration process. After the brown bit body 102 is placed in the mold 500, a space 510 between the brown bit body 102 and the interior surface 506 of the lower portion 502 is filled with metal or metal alloy particles to be made molten to infiltrate the brown bit body 102. While the volume of the metal or metal alloy particles will vary initially, approximately a volume of 140% of the theoretical pore-like passage space or interstitial space within the brown bit body 102 is placed in the space 510 so that the space 510 is completely filled with metal or metal alloy particles to the top of the brown bit body 102 with the metal or metal alloy particles being packed in the space 510. After filling and packing the space 510 with metal or metal alloy particles, the upper portion 504 of the mold 500 is placed on the lower portion 502 and the mold 500 placed in a furnace 600 (shown in dashed lines) at a sufficient temperature and for a sufficient time and in a reducing atmosphere or a vacuum for the metal or metal alloy particles to melt and infiltrate the brown bit body 102 by being wicked therein. Alternatively, the space 510 may be pressurized by a suitable fluid source, such as pressurized hydrogen gas, through fluid port 512 to assist infiltration of the metal or metal alloy into the brown bit body 102. Additionally, if desired, a vacuum may be applied through fluid port 514 which communicates with an interior space 516 of the brown bit body 102 either when the space 510 is not pressurized or is pressurized, to assist infiltration of the metal or metal alloy into the brown bit body 102. It is understood that if the space 510 is pressurized and/or the space 516 has a vacuum applied thereto, the upper end of the brown bit body 102 will sealingly engage a portion of the upper portion 504 of the mold 500 to prevent any fluid pressure from fluid port 512 leaking into the space 516 or any vacuum applied through fluid port 514 from leaking into the space 510 so that a pressure differential may be maintained across the brown bit body 102 from the exterior thereof to the space 516 formed therein. The amount of pressure differential used to assist metal or metal alloy infiltration into brown bit body 102 will vary as it will be determined by various factors, such as the characteristics of the mold 500, the size of the brown bit body 102, the temperature used during the infiltration of the brown bit body 102, the size of the metal or metal alloy particles used for infiltration of the brown bit body 102, the time duration of the infiltration process of the brown bit body 102, the average pore size in the brown bit body 102, etc.

Alternatively, as illustrated in FIG. 3F, the brown bit body 102 may be placed in a mold 500 where the upper portion 504 includes a passageway therethrough to the space 510 so that molten infiltrant, such as molten copper alloy, can be flowed into the space 510 in the mold 500 when the mold 500 is in the furnace 600 so that the molten infiltrant can infiltrate the brown bit body 102. Alternatively, the space 510 may be pressurized by a suitable fluid source, such as pressurized hydrogen gas, through fluid port 512 to assist infiltration of the metal or metal alloy into the brown bit body 102. Additionally, if desired, a vacuum may be applied through fluid port 514 which communicates with the interior space 516 of the brown bit body 102 either when the space 510 is not pressurized or is pressurized, to assist infiltration of the metal or metal alloy into the brown bit body 102. It is understood that if the space 510 is pressurized and/or the space 516 has a vacuum applied thereto, the upper end of the brown bit body 102 will sealingly engage a portion of the upper portion 504 of the mold 500 to prevent any fluid pressure from fluid port 512 leaking into the space 516 or any vacuum applied through fluid port 514 from leaking into the space 510 so that a pressure differential may be maintained across the brown bit body 102 from the exterior thereof to the space 516 formed therein. The amount of pressure differential used to assist metal or metal alloy infiltration into brown bit body 102 will vary, as it will be determined by various factors, such as the characteristics of the mold 500, the size of the brown bit body 102, the temperature used during the infiltration of the brown bit body 102, the size of the metal or metal alloy particles used for infiltration of the brown bit body 102, the time duration of the infiltration process of the brown bit body 102, etc. If too great a pressure differential is used to assist the metal or metal alloy infiltration into the brown bit body 102, the metal or metal alloy will tend to pool on one side of the brown bit body 102 rather than being evenly distributed.

In FIG. 3G, the shaped brown bit body 102 is illustrated placed in a mold 500 including a lower portion 502 and an upper portion 504. The lower portion 502 has an interior surface 506 which generally matches the topography of the brown bit body 102 therein. The mold 500 is typically machined from a cylindrical graphite element or formed from other heat-resistant material able to withstand the temperatures of an infiltration process. The brown bit body 102 is placed in the mold 500 and an insert 515 is placed in the cavity 516 in the brown bit body 102 being supported therein from the bottom of the cavity 516. After the brown bit body 102 is placed in the mold 500, the space 510 between the brown bit body 102 and the interior surface 506 of the lower portion 502 and a space 511 between the insert 515 and the cavity 516 is filled with metal or metal alloy particles to be made molten to infiltrate the brown bit body 102. While the volume of the metal or metal alloy particles will vary, initially, approximately a volume of 140% of the theoretical pore-like passage space or interstitial space of the brown bit body 102 is placed in the space 510 so that the space 510 is completely filled with metal or metal alloy particles to the top of the brown bit body 102 with the metal or metal alloy particles being packed in the space 510. After filling and packing the space 510 with metal or metal alloy particles, the upper portion 504 of the mold 500 is placed on the lower portion 502 and the mold 500 placed in a furnace 600 (shown in dashed lines) at a sufficient temperature and for a sufficient time and in a reducing atmosphere or a vacuum for the metal or metal alloy particles to melt and infiltrate the brown bit body 102 by being wicked therein. Alternatively, the space 510 may be pressurized by a suitable fluid source, such as pressurized hydrogen gas, through fluid port 512 to assist infiltration of the metal or metal alloy into the brown bit body 102. Additionally, if desired, a vacuum may be applied through fluid port 514 which communicates with the interior space 516 of the brown bit body 102, either when the space 510 is not pressurized or is pressurized, to assist infiltration of the metal or metal alloy into the brown bit body 102. It is understood that if the space 510 is pressurized and/or the space 516 has a vacuum applied thereto, the upper end of the brown bit body 102 will sealingly engage a portion of the upper portion 504 of the mold 500 to prevent any fluid pressure from fluid port 512 leaking into the space 516 or any vacuum applied through fluid port 514 from leaking into the space 510 so that a pressure differential may be maintained across the brown bit body 102 from the exterior thereof to the space 516 formed therein. The amount of pressure differential used to assist metal or metal alloy infiltration into brown bit body 102 will vary, as it will be determined by various factors, such as the characteristics of the mold 500, the size of the brown bit body 102, the temperature used during the infiltration of the brown bit body 102, the size of the metal or metal alloy particles used for infiltration of the brown bit body 102, the time duration of the infiltration process of the brown bit body 102, the average pore size in the brown bit body 102, etc. Since the metal or metal alloy is being infiltrated from both the interior and the exterior of the brown bit body 102, the amount of pressure differential used to assist the metal or metal alloy during infiltration must be slight, otherwise, the metal or metal alloy will tend to pool on one side of the brown bit body 102.

Alternatively, as illustrated in FIG. 3H, the brown bit body 102 may be placed in a mold 500 where the upper portion 504 includes a passageways therethrough to the spaces 510 and 511 so that molten infiltrant, such as molten copper alloy, can be flowed into the spaces 510 and 511 in the mold 500 when the mold 500 is in the furnace 600 so that the molten infiltrant can infiltrate the brown bit body 102. Alternatively, the space 510 may be pressurized by a suitable fluid source, such as pressurized hydrogen gas, through fluid port 512 to assist infiltration of the metal or metal alloy into the brown bit body 102. Additionally, if desired, a vacuum may be applied through fluid port 514 which communicates with the interior space 516 of the brown bit body 102 either when the space 510 is not pressurized or is pressurized, to assist infiltration of the metal or metal alloy into the brown bit body 102. It is understood that if the space 510 is pressurized and/or the space 516 has a vacuum applied thereto, the upper end of the brown bit body 102 will sealingly engage a portion of the upper portion 504 of the mold 500 to prevent any fluid pressure from fluid port 512 leaking into the space 516 or any vacuum applied through fluid port 514 from leaking into the space 510 so that a pressure differential may be maintained across the brown bit body 102 from the exterior thereof to the space 516 formed therein. The amount of pressure differential used to assist metal or metal alloy infiltration into brown bit body 102 will vary, as it will be determined by various factors, such as the characteristics of the mold 500, the size of the brown bit body 102, the temperature used during the infiltration of the brown bit body 102, the size of the metal or metal alloy particles used for infiltration of the brown bit body 102, the time duration of the infiltration process of the brown bit body 102, etc. Since the metal or metal alloy is being infiltrated from both the interior and the exterior of the brown bit body 102, the amount of pressure differential used to assist the metal or metal alloy during infiltration must be slight, otherwise, the metal or metal alloy will tend to pool on one side of the brown bit body 102.

After the brown bit body 102 has been infiltrated, the shaped brown bit body 106 shown in FIG. 3E, FIG. 3F, FIG. 3G, or FIG. 3H then may be fully sintered to a desired final density to provide the previously described bit body 52 shown in FIG. 2 and FIG. 3I. As any sintering involves densification and removal of porosity within a structure, the structure being sintered will shrink during the sintering process. In an uninfiltrated structure, a structure may experience linear shrinkage of between 10% and 20% during sintering from a green state to a desired final density. As a result, dimensional shrinkage must be considered and accounted for when designing tooling (molds, dies, etc.) or machining features in structures that are less than fully sintered. In an infiltrated structure which is sintered to a desired final density, it is anticipated that the structure may experience a linear shrinkage of approximately 1% or 2%±1% depending upon the amount of closed pore space in the structure which cannot be infiltrated with the metal or metal alloy.

During all sintering and partial sintering processes, refractory structures or displacements (not shown) may be used to support at least portions of the bit body during the sintering process to maintain desired shapes and dimensions during the densification process. Such displacements may be used, for example, to maintain consistency in the size and geometry of the cutter pockets 36 and the internal fluid passageways 42 during the sintering process. Such refractory structures may be formed from, for example, graphite, silica, or alumina. The use of alumina displacements instead of graphite displacements may be desirable as alumina may be relatively less reactive than graphite, thereby minimizing atomic diffusion during sintering. Additionally, coatings such as alumina, boron nitride, aluminum nitride, or other commercially available materials may be applied to the refractory structures (e.g., molds and/or displacements) to prevent carbon or other atoms in the refractory structures from diffusing into the bit body during densification.

In alternative methods, the green bit body 94 shown in FIG. 3B may be partially sintered to form a brown bit body without prior machining, and all necessary machining may be performed on the brown bit body prior to infiltrating the brown bit body and fully sintering the brown bit body to a desired final density. Alternatively, all necessary machining may be performed on the green bit body 94 shown in FIG. 3B, which then may be infiltrated and fully sintered to a desired final density.

The sintering processes described herein may include conventional sintering in a vacuum furnace, sintering in a vacuum furnace followed by a conventional hot isostatic pressing process, and sintering immediately followed by isostatic pressing at temperatures near the sintering temperature (often referred to as sinter-HIP). Alternatively, the brown bit body may be infiltrated and subjected to HIP in an argon atmosphere at suitable temperature and pressure for a suitable period of time-dependent upon the material composition of the brown bit body, such as pressures in the range of 35 megapascals (about 5,000 pounds per square inch) to 310 megapascals (about 45,000 pounds per square inch) and a temperature range of 250° C. to 2000° C. When a brown body which has been infiltrated is treated with HIP, the simultaneous application of heat and pressure essentially eliminates any internal voids and microporosity which remain after infiltration of the brown body through a combination of plastic deformation, creep, and diffusion bonding. In this manner, with the use of HIP after infiltration of a brown body, sintering is not required.

In some embodiments, the sintering processes described herein may include solid-state sintering. In other words, the sintering processes may be conducted at temperatures proximate to but below the solidus line of the phase diagram for the matrix material forming a portion of the particle-matrix composite material. In other embodiments, the sintering processes described herein may include liquid phase sintering. In other words, the sintering processes may be conducted at temperatures proximate to but below the liquidus line of the phase diagram for the matrix material forming a portion of the particle-matrix composite material. For example, the sintering processes described herein may be conducted using a number of different methods known to one of ordinary skill in the art, such as the Rapid Omnidirectional Compaction (ROC) process, the -CERACON® process, hot isostatic pressing (HIP), or adaptations of such processes.

Broadly, and by way of example only, sintering a green powder compact using the ROC process involves presintering the green powder compact at a relatively low temperature to only a sufficient degree to develop sufficient strength to permit handling of the powder compact. The resulting brown structure is wrapped in a material such as graphite foil to seal the brown structure. The wrapped brown structure is placed in a container, which is filled with particles of a ceramic, polymer, or glass material having a substantially lower melting point than that of the matrix material in the brown structure. The container is heated to the desired sintering temperature, which is above the melting temperature of the particles of a ceramic, polymer, or glass material, but below the liduidus temperature of the matrix material in the brown structure. The heated container with the molten ceramic, polymer, or glass material (and the brown structure immersed therein) is placed in a mechanical or hydraulic press, such as a forging press, that is used to apply pressure to the molten ceramic or polymer material. Isostatic pressures within the molten ceramic, polymer, or glass material facilitate consolidation and sintering of the brown structure at the elevated temperatures within the container. The molten ceramic, polymer, or glass material acts to transmit the pressure and heat to the brown structure. In this manner, the molten ceramic, polymer, or glass acts as a pressure transmission medium through which pressure is applied to the structure during sintering. Subsequent to the release of pressure and cooling, the sintered structure is then removed from the ceramic, polymer, or glass material. A more detailed explanation of the ROC process and suitable equipment for the practice thereof is provided by U.S. Pat. Nos. 4,094,709, 4,233,720, 4,341,557, 4,526,748, 4,547,337, 4,562,990, 4,596,694, 4,597,730, 4,656,002 4,744,943 and 5,232,522, the disclosure of each of which patents is incorporated herein by reference.

The -CERACON® process, which is similar to the aforementioned ROC process, may also be adapted for use in the present invention to fully sinter brown structures to a final density. In the -CERACON® process, the brown structure is coated with a ceramic coating such as alumina, zirconium oxide, or chrome oxide. Other similar, hard, generally inert, protective, removable coatings may also be used. The coated brown structure is fully consolidated by transmitting at least substantially isostatic pressure to the coated brown structure using ceramic particles instead of a fluid media as in the ROC process. A more detailed explanation of the -CERACON® process is provided by U.S. Pat. No. 4,499,048, the disclosure of which patent is incorporated herein by reference.

Furthermore, in embodiments of the invention in which tungsten carbide is used in a particle-matrix composite bit body, the sintering processes described herein also may include a carbon control cycle tailored to improve the stoichiometry of the tungsten carbide material. By way of example and not limitation, if the tungsten carbide material includes WC, the sintering processes described herein may include subjecting the tungsten carbide material to a gaseous mixture including hydrogen and methane at elevated temperatures. For example, the tungsten carbide material may be subjected to a flow of gases including hydrogen and methane at a temperature of about 1,000° C.

As previously discussed, several different methods may be used to attach the shank 70 to the bit body 52. In the embodiment shown in FIG. 2, the shank 70 may be attached to the bit body 52 by brazing or soldering the interface between the surface 60 of the bit body 52 and the surface 72 of the shank 70. The bit body 52 and the shank 70 may be sized and configured to provide a predetermined standoff between the surface 60 and the surface 72, in which the brazing alloy 74 may be provided. Furthermore, the brazing alloy 74 may be applied to the interface between the surface 60 of the bit body 52 and the surface 72 of the shank 70 using a furnace brazing process or a torch brazing process. The brazing alloy 74 may include, for example, a copper-based, silver-based or a nickel-based alloy.

As previously mentioned, a shrink fit may be provided between the shank 70 and the bit body 52 in alternative embodiments of the invention. By way of example and not limitation, the shank 70 may be heated to cause thermal expansion of the shank 70 while the bit body 52 is cooled to cause thermal contraction of the bit body 52. The shank 70 then may be pressed onto the bit body 52 and the temperatures of the shank 70 and the bit body 52 may be allowed to equilibrate. As the temperatures of the shank 70 and the bit body 52 equilibrate, the surface 72 of the shank 70 may engage or abut against the surface 60 of the bit body 52, thereby at least partly securing the bit body 52 to the shank 70 and preventing separation of the bit body 52 from the shank 70.

Alternatively, a friction weld may be provided between the bit body 52 and the shank 70. Mating surfaces may be provided on the shank 70 and the bit body 52. A machine may be used to press the shank 70 against the bit body 52 while rotating the bit body 52 relative to the shank 70. Heat generated by friction between the shank 70 and the bit body 52 may at least partially melt the material at the mating surfaces of the shank 70 and the bit body 52. The relative rotation may be stopped and the bit body 52 and the shank 70 may be allowed to cool while maintaining axial compression between the bit body 52 and the shank 70, providing a friction welded interface between the mating surfaces of the shank 70 and the bit body 52.

Commercially available adhesives such as, for example, epoxy materials (including inter-penetrating network (IPN) epoxies), polyester materials, cyanacrylate materials, polyurethane materials, and polyimide materials may also be used to secure the shank 70 to the bit body 52.

As previously described, a weld 24 may be provided between the bit body 52 and the shank 70 that extends around the drill bit 50 on an exterior surface thereof along an interface between the bit body 52 and the shank 70. A shielded metal arc welding (SMAW) process, a gas metal arc welding (GMAW) process, a plasma transferred arc (PTA) welding process, a submerged arc welding process, an electron beam welding process, or a laser beam welding process may be used to weld the interface between the bit body 52 and the shank 70. Furthermore, the interface between the bit body 52 and the shank 70 may be soldered or brazed using processes known in the art to further secure the bit body 52 to the shank 70.

Referring again to FIG. 2, wear-resistant hardfacing materials (not shown) may be applied to selected surfaces of the bit body 52 and/or the shank 70. For example, hardfacing materials may be applied to selected areas on exterior surfaces of the bit body 52 and the shank 70, as well as to selected areas on interior surfaces of the bit body 52 and the shank 70 that are susceptible to erosion, such as, for example, surfaces within the internal fluid passageways 42. Such hardfacing materials may include a particle-matrix composite material, which may include, for example, particles of tungsten carbide dispersed throughout a continuous matrix material. Conventional flame spray techniques may be used to apply such hardfacing materials to surfaces of the bit body 52 and/or the shank 70. Known welding techniques, such as oxy-acetylene, metal inert gas (MIG), tungsten inert gas (TIG), atomic hydrogen welding (AHW), and plasma transferred arc welding (PTAW) techniques, also may be used to apply hardfacing materials to surfaces of the bit body 52 and/or the shank 70.

Cold spray techniques provide another method by which hardfacing materials may be applied to surfaces of the bit body 52 and/or the shank 70. In cold spray techniques, energy stored in high pressure compressed gas is used to propel fine powder particles at very high velocities (500-1500 m/s) at the substrate. Compressed gas is fed through a heating unit to a gun where the gas exits through a specially designed nozzle at very high velocity. Compressed gas is also fed via a high pressure powder feeder to introduce the powder material into the high velocity gas jet. The powder particles are moderately heated and accelerated to a high velocity toward the substrate. On impact the particles deform and bond to form a coating of hardfacing material.

Yet another technique for applying hardfacing material to selected surfaces of the bit body 52 and/or the shank 70 involves applying a first cloth or fabric comprising a carbide material to selected surfaces of the bit body 52 and/or the shank 70 using a low temperature adhesive, applying a second layer of cloth or fabric containing brazing or matrix material over the fabric of carbide material, and heating the resulting structure in a furnace to a temperature above the melting point of the matrix material. The molten matrix material is wicked into the tungsten carbide cloth, metallurgically bonding the tungsten carbide cloth to the bit body 52 and/or the shank 70 and forming the hardfacing material. Alternatively, a single cloth that includes a carbide material and a brazing or matrix material may be used to apply hardfacing material to selected surfaces of the bit body 52 and/or the shank 70. Such cloths and fabrics are commercially available from, for example, Conforma Clad, Inc. of New Albany, Ind.

Conformable sheets of hardfacing material that include diamond may also be applied to selected surfaces of the bit body 52 and/or the shank 70.

Figure 4:
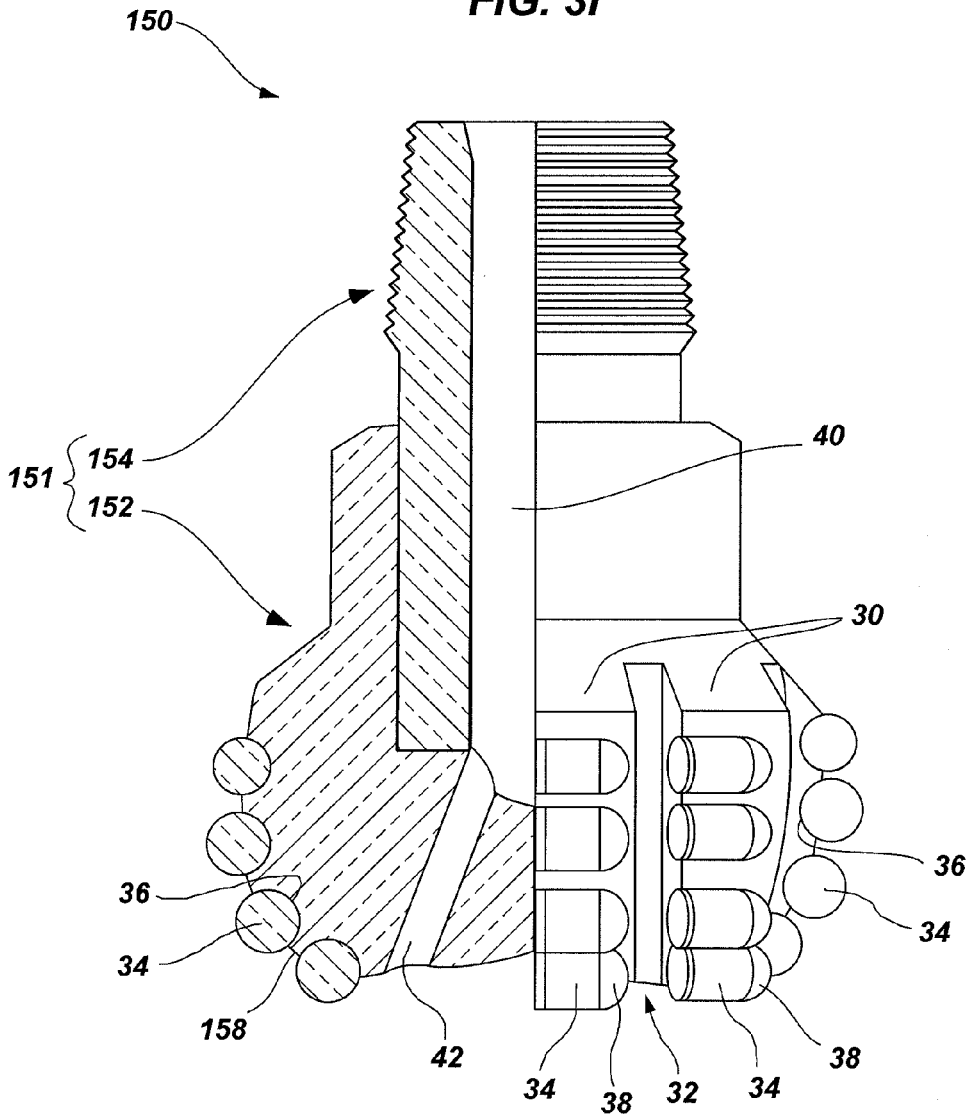
FIG. 4 is a partial cross-sectional side view of another earth-boring rotary drill bit that embodies teachings of the present invention and has a bit body that includes a particle-matrix composite material.

Another earth-boring rotary drill bit 150 that embodies teachings of the present invention is shown in FIG. 4. The drill bit 150 includes a unitary structure 151 that includes a bit body 152 and a threaded pin 154. The unitary structure 151 is substantially formed from and composed of a particle-matrix composite material. In this configuration, it may not be necessary to use a separate shank to attach the drill bit 150 to a drill string.

The bit body 152 includes blades 30, which are separated by junk slots 32. Internal fluid passageways 42 extend between the face 158 of the bit body 152 and a longitudinal bore 40, which at least partially extends through the unitary structure 151. Nozzle inserts (not shown) may be provided at face 158 of the bit body 152 within the internal fluid passageways 42.

The drill bit 150 may include a plurality of PDC cutters 34 disposed on the face 158 of the bit body 152. The PDC cutters 34 may be provided along blades 30 within pockets 36 formed in the face 158 of the bit body 152, and may be supported from behind by buttresses 38, which may be integrally formed with the bit body 152. Alternatively, the drill bit 150 may include a plurality of cutters each comprising an abrasive, wear-resistant material such as, for example, cemented tungsten carbide.

The unitary structure 151 may include a plurality of regions. Each region may comprise a particle-matrix composite material having a material composition that differs from other regions of the plurality of regions. For example, the bit body 152 may include a particle-matrix composite material having a first material composition, and the threaded pin 154 may include a particle-matrix composite material having a second material composition that is different from the first material composition. In this configuration, the material composition of the bit body 152 may exhibit a physical property that differs from a physical property exhibited by the material composition of the threaded pin 154. For example, the first material composition may exhibit higher erosion and wear-resistance relative to the second material composition, and the second material composition may exhibit higher fracture toughness relative to the first material composition.

In one embodiment of the present invention, the particle-matrix composite material of the bit body 152 (the first composition) may include a plurality of −635 ASTM mesh tungsten carbide particles. More particularly, the particle-matrix composite material of the bit body 152 (the first composition) may include a plurality of tungsten carbide particles having an average diameter in a range from about 0.5 micron to about 20 microns. The matrix material of the first composition may include a cobalt-based metal alloy comprising greater than about 98% cobalt by weight. The tungsten carbide particles may comprise between about 75% and about 85% by weight of the first composition of particle-matrix composite material, and the matrix material may comprise between about 15% and about 25% by weight of the first composition of particle-matrix composite material. The particle-matrix composite material of the threaded pin 154 (the second composition) may include a plurality of −635 ASTM mesh tungsten carbide particles. More particularly, the particle-matrix composite material of the threaded pin 154 may include a plurality of tungsten carbide particles having an average diameter in a range from about 0.5 micron to about 20 microns. The matrix material of the second composition may include a cobalt-based metal alloy comprising greater than about 98% cobalt by weight. The tungsten carbide particles may comprise between about 65% and about 70% by weight of the second composition of particle-matrix composite material, and the matrix material may comprise between about 30% and about 35% by weight of the second composition of particle-matrix composite material.

The drill bit 150 shown in FIG. 4 includes two distinct regions, each of which comprises a particle-matrix composite material having a unique material composition. In alternative embodiments, the drill bit 150 may include three or more different regions, each having a unique material composition. Furthermore, a discrete boundary is identifiable between the two distinct regions of the drill bit 150 shown in FIG. 4. In alternative embodiments, a continuous material composition gradient may be provided throughout the unitary structure 151 to provide a drill bit having a plurality of different regions, each having a unique material composition, but lacking any identifiable boundaries between the various regions. In this manner, the physical properties and characteristics of different regions within the drill bit 150 may be tailored to improve properties such as, for example, wear-resistance, fracture toughness, strength, or weldability in strategic regions of the drill bit 150. It is understood that the various regions of the drill bit may have material compositions that are selected or tailored to exhibit any desired particular physical property or characteristic, and the present invention is not limited to selecting or tailoring the material compositions of the regions to exhibit the particular physical properties or characteristics described herein.

One method that may be used to form the drill bit 150 shown in FIG. 4 will now be described with reference to FIGS. 5A-5O. The method involves separately forming the bit body 152 and the threaded pin 154 in the green and brown states, assembling the bit body 152 with the threaded pin 154 in the brown state to provide the unitary structure 151 and sintering the unitary structure 151 to a desired final density. The bit body 152 is bonded and secured to the threaded pin 154 during the sintering process.

Figure 5A:
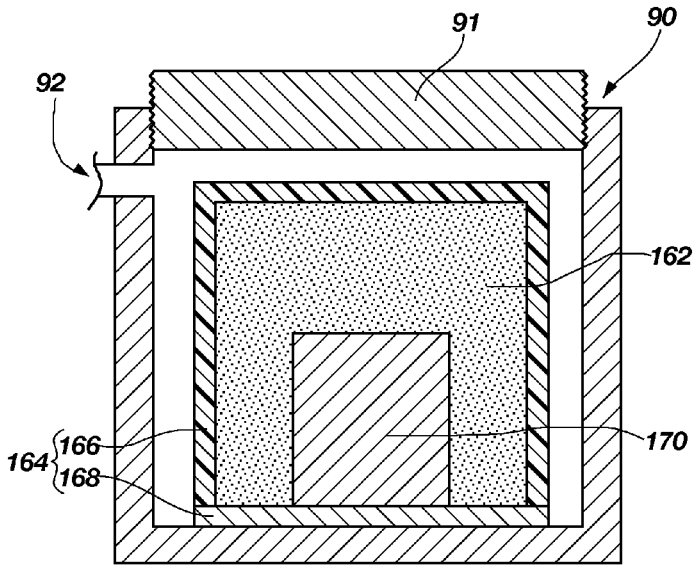
FIGS. 5A-5O illustrate a method of forming the earth-boring rotary drill bit shown in FIG. 4.

Referring to FIGS. 5A-5E, the bit body 152 may be formed in the green state using an isostatic pressing process. As shown in FIG. 5A, a powder mixture 162 may be pressed with substantially isostatic pressure within a mold or container 164. The powder mixture 162 may include a plurality of hard particles and a plurality of particles comprising a matrix material. The hard particles and the matrix material may be substantially identical to those previously discussed in relation to the drill bit 50 shown in FIG. 2. Optionally, the powder mixture 162 may further include additives commonly used when pressing powder mixtures such as, for example, binders for providing lubrication during pressing and for providing structural strength to the pressed powder component, plasticizers for making the binder more pliable, and lubricants or compaction aids for reducing inter-particle friction.

The container 164 may include a fluid-tight deformable member 166 and a sealing plate 168. For example, the fluid-tight deformable member 166 may be a substantially cylindrical bag comprising a deformable polymer material. The deformable member 166 may be formed from, for example, a deformable polymer material. The deformable member 166 may be filled with the powder mixture 162. The deformable member 166 and the powder mixture 162 may be vibrated to provide a uniform distribution of the powder mixture 162 within the deformable member 166. At least one displacement or insert 170 may be provided within the deformable member 166 for defining features such as, for example, the longitudinal bore 40 (FIG. 4). Alternatively, the insert 170 may not be used and the longitudinal bore 40 may be formed using a conventional machining process during subsequent processes. The sealing plate 168 then may be attached or bonded to the deformable member 166 providing a fluid-tight seal therebetween.

The container 164 (with the powder mixture 162 and any desired inserts 170 contained therein) may be provided within a pressure chamber 90. A removable cover 91 may be used to provide access to the interior of the pressure chamber 90. A fluid (which may be substantially incompressible) such as, for example, water, oil, or gas (such as, for example, air or nitrogen) is pumped into the pressure chamber 90 through an opening 92 using a pump (not shown). The high pressure of the fluid causes the walls of the deformable member 166 to deform. The pressure may be transmitted substantially uniformly to the powder mixture 162. The pressure within the pressure chamber 90 during isostatic pressing may be greater than about 35 megapascals (about 5,000 pounds per square inch). More particularly, the pressure within the pressure chamber 90 during isostatic pressing may be greater than about 138 megapascals (20,000 pounds per square inch). In alternative methods, a vacuum may be provided within the container 164 and a pressure greater than about 0.1 megapascal (about 15 pounds per square inch) may be applied to the exterior surfaces of the container 164 (by, for example, the atmosphere) to compact the powder mixture 162. Isostatic pressing of the powder mixture 162 may form a green powder component or green bit body 174 shown in FIG. 5B, which can be removed from the pressure chamber 90 and container 164 after pressing.

Figure 5B:
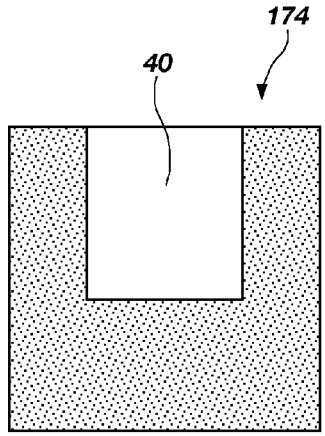

In an alternative method of pressing the powder mixture 162 to form the green bit body 174 shown in FIG. 5B, the powder mixture 162 may be uniaxially pressed in a mold or container (not shown) using a mechanically or hydraulically actuated plunger by methods that are known to those of ordinary skill in the art of powder processing.

The green bit body 174 shown in FIG. 5B may include a plurality of particles held together by binder materials provided in the powder mixture 162 (FIG. 5A). Certain structural features may be machined in the green bit body 174 using conventional machining techniques including, for example, turning techniques, milling techniques, and drilling techniques. Hand held tools also may be used to manually form or shape features in or on the green bit body 174.

Figure 5C:
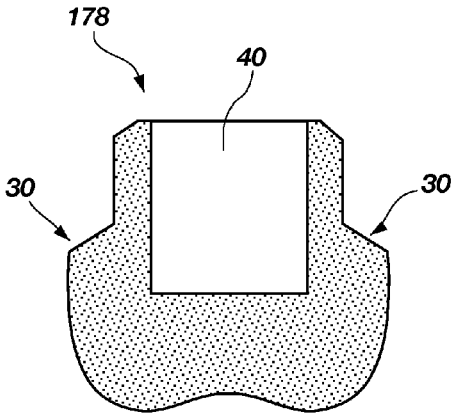

By way of example and not limitation, blades 30, junk slots 32 (FIG. 4), and any other features may be formed in the green bit body 174 to form a shaped green bit body 178 shown in FIG. 5C.

Figure 5D:
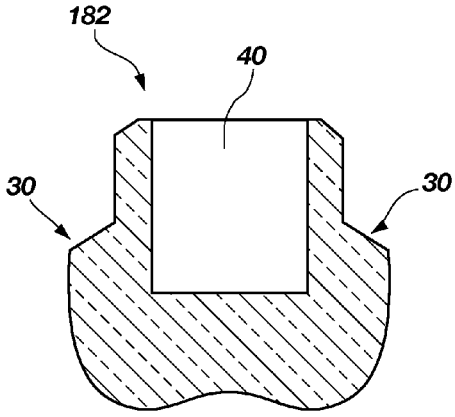

The shaped green bit body 178 shown in FIG. 5C may be at least partially sintered to provide a brown bit body 82 shown in FIG. 5D, which has less than a desired final density. Prior to sintering, the shaped green bit body 178 may be subjected to elevated temperatures to burn off or remove any fugitive additives that were included in the powder mixture 162 (FIG. 5A) as previously described. Furthermore, the shaped green bit body 178 may be subjected to a suitable atmosphere tailored to aid in the removal of such additives. Such atmospheres may include, for example, hydrogen gas at temperatures of about 500° C.

The brown bit body 182 may be substantially machinable due to the remaining porosity therein. Certain structural features may be machined in the brown bit body 182 using conventional machining techniques including, for example, turning techniques, milling techniques, and drilling techniques. Hand held tools also may be used to manually form or shape features in or on the brown bit body 182. Furthermore, cutting tools that include super hard coatings or inserts may be used to facilitate machining of the brown bit body 182. Additionally, coatings may be applied to the brown bit body 182 prior to machining to reduce chipping of the brown bit body 182. Such coatings may include a fixative or other polymer material.

Figure 5E:
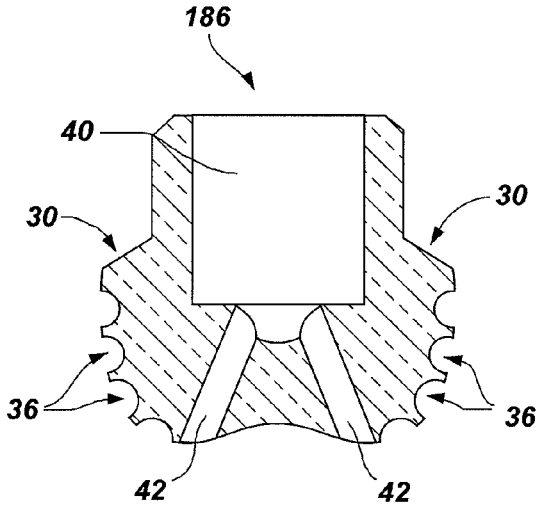

By way of example and not limitation, internal fluid passageways 42, cutter pockets 36, and buttresses 38 (FIG. 4) may be formed in the brown bit body 182 to form a shaped brown bit body 186 shown in FIG. 5E. Furthermore, if the drill bit 150 is to include a plurality of cutters integrally formed with the bit body 152, the cutters may be positioned within the cutter pockets 36 formed in the brown bit body 182. Upon subsequent sintering of the brown bit body 182, the cutters may become bonded to and integrally formed with the bit body 152.

Figure 5F:
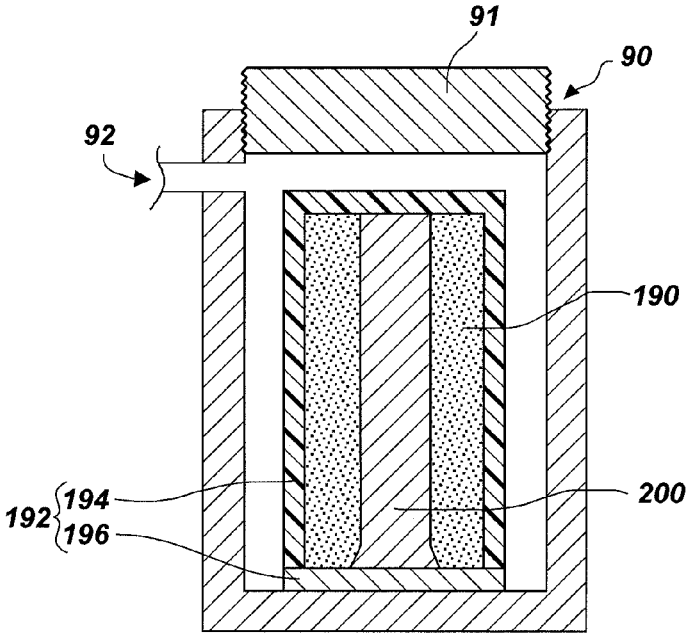

Referring to FIGS. 5F-5J, the threaded pin 154 may be formed in the green state using an isostatic pressing process substantially identical to that used to form the bit body 152. As shown in FIG. 5F, a powder mixture 190 may be pressed with substantially isostatic pressure within a mold or container 192. The powder mixture 190 may include a plurality of hard particles and a plurality of particles comprising a matrix material. The hard particles and the matrix material may be substantially identical to those previously discussed in relation to the drill bit 50 shown in FIG. 2. Optionally, the powder mixture 190 may further include additives commonly used when pressing powder mixtures, as previously described.

The container 192 may include a fluid-tight deformable member 194 and a sealing plate 196. The deformable member 194 may be formed from, for example an elastomer such as rubber, neoprene, silicone, or polyurethane. The deformable member 194 may be filled with the powder mixture 190. The deformable member 194 and the powder mixture 190 may be vibrated to provide a uniform distribution of the powder mixture 190 within the deformable member 194. At least one displacement or insert 200 may be provided within the deformable member 194 for defining features such as, for example, the longitudinal bore 40 (FIG. 4). Alternatively, the insert 200 may not be used and the longitudinal bore 40 may be formed using a conventional machining process during subsequent processes. The sealing plate 196 then may be attached or bonded to the deformable member 194 providing a fluid-tight seal therebetween.

The container 192 (with the powder mixture 190 and any desired inserts 200 contained therein) may be provided within a pressure chamber 90. A removable cover 91 may be used to provide access to the interior of the pressure chamber 90. A fluid (which may be substantially incompressible) such as, for example, water, oil, or gas (such as, for example, air or nitrogen) is pumped into the pressure chamber 90 through an opening 92 using a pump (not shown). The high pressure of the fluid causes the walls of the deformable member 194 to deform. The pressure may be transmitted substantially uniformly to the powder mixture 190. The pressure within the pressure chamber 90 during isostatic pressing may be greater than about 35 megapascals (about 5,000 pounds per square inch). More particularly, the pressure within the pressure chamber 90 during isostatic pressing may be greater than about 138 megapascals (20,000 pounds per square inch). In alternative methods, a vacuum may be provided within the container 192 and a pressure greater than about 0.1 megapascal (about 15 pounds per square inch) may be applied to the exterior surfaces of the container 192 (by, for example, the atmosphere) to compact the powder mixture 190. Isostatic pressing of the powder mixture 190 may form a green powder component or green pin 204 shown in FIG. 5G, which can be removed from the pressure chamber 90 and container 192 after pressing.

Figure 5G:
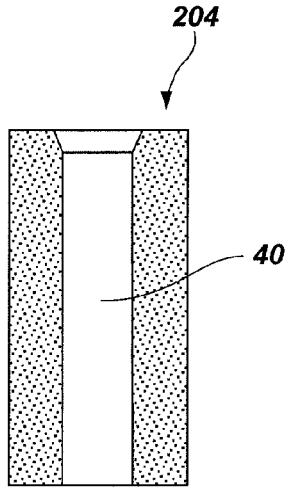

In an alternative method of pressing the powder mixture 190 to form the green pin 204 shown in FIG. 5G, the powder mixture 190 may be uniaxially pressed in a mold or container (not shown) using a mechanically or hydraulically actuated plunger by methods that are known to those of ordinary skill in the art of powder processing.

The green pin 204 shown in FIG. 5G may include a plurality of particles held together by binder materials provided in the powder mixture 190 (FIG. 5F). Certain structural features may be machined in the green pin 204 using conventional machining techniques including, for example, turning techniques, milling techniques, and drilling techniques. Hand held tools also may be used to manually form or shape features in or on the green pin 204 if necessary.

Figure 5H:
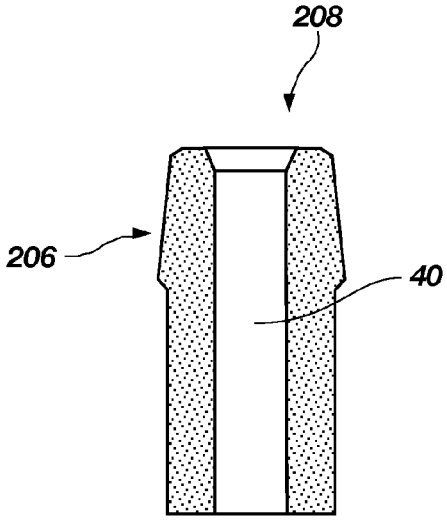
Figure 5I:
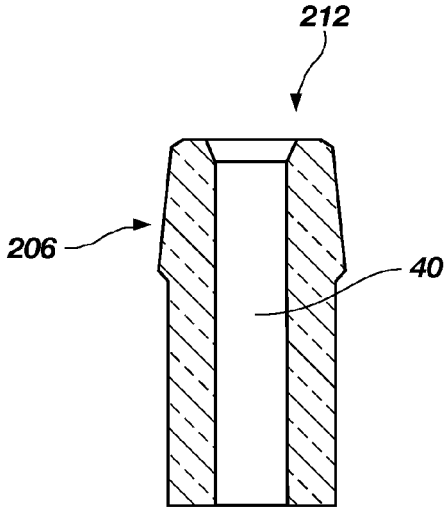

By way of example and not limitation, a tapered surface 206 may be formed on an exterior surface of the green pin 204 to form a shaped green pin 208 shown in FIG. 5H.

The shaped green pin 208 shown in FIG. 5H may be at least partially sintered at elevated temperatures in a furnace. For example, the shaped green pin 208 may be partially sintered to provide a brown pin 212 shown in FIG. 5I, which has less than a desired final density. Prior to sintering, the shaped green pin 208 may be subjected to elevated temperatures to burn off or remove any fugitive additives that were included in the powder mixture 190 (FIG. 5F) as previously described. Furthermore, the shaped green pin 208 may be subjected to a suitable atmosphere tailored to aid in the removal of such additives. Such atmospheres may include, for example, hydrogen gas at temperatures of about 500° C.

The brown pin 212 may be substantially machinable due to the remaining porosity therein. Certain structural features may be machined in the brown pin 212 using conventional machining techniques including, for example, turning techniques, milling techniques, and drilling techniques. Hand held tools also may be used to manually form or shape features in or on the brown pin 212. Furthermore, cutting tools that include super hard coatings or inserts may be used to facilitate machining of the brown pin 212. Additionally, coatings may be applied to the brown pin 212 prior to machining to reduce chipping of the brown pin 212. Such coatings may include a fixative or other polymer material.

Figure 5J:
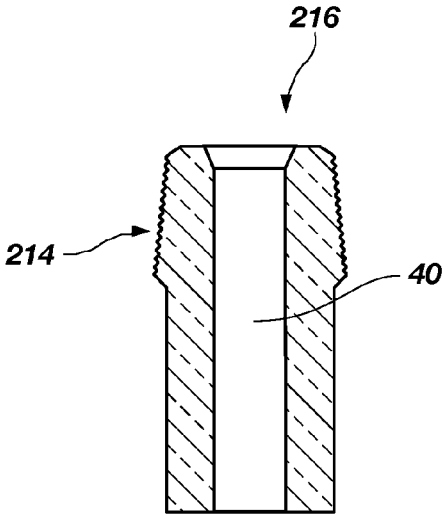

By way of example and not limitation, threads 214 may be formed in the brown pin 212 to form a shaped brown threaded pin 216 shown in FIG. 5J.

Figure 5K:
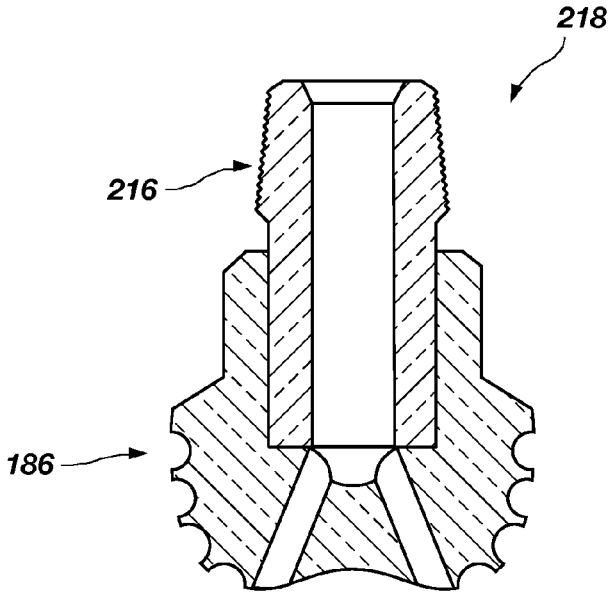

The shaped brown threaded pin 216 shown in FIG. 5J then may be inserted into the previously formed shaped brown bit body 186 shown in FIG. 5E to form a brown unitary structure 218 shown in FIG. 5K.

Figure 5L:
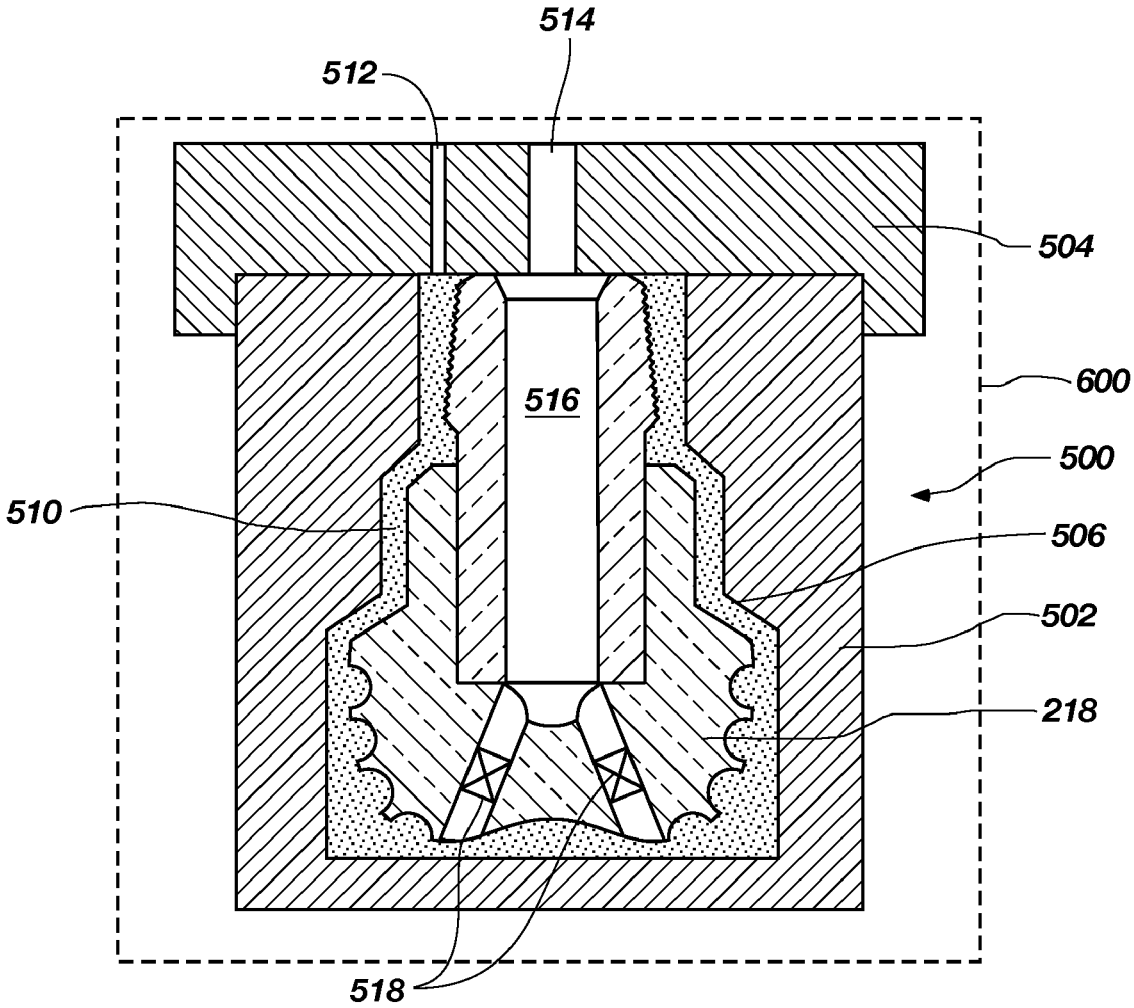

The brown unitary structure 218 as illustrated in FIG. 5L is placed in a mold 500 including a lower portion 502 and an upper portion 504. The lower portion 502 has an interior surface 506 which generally matches the topography of the brown unitary structure 218 therein. The mold 500 is typically machined from a cylindrical graphite element or formed from other heat-resistant material able to withstand the temperatures of an infiltration process. After the brown unitary structure 218 is placed in the mold 500, the space 510 between the brown bit body 102 and the interior surface 506 of the lower portion 502 is filled with metal or metal alloy particles to be made molten to infiltrate the brown unitary structure 218. While the volume of the metal or metal alloy particles will vary, initially, approximately a volume of 140% of the theoretical pore-like passage space or interstitial space of the brown unitary structure 218 is placed in the space 510 so that the space 510 is completely filled with metal or metal alloy particles to the top of the brown unitary structure 218 with the metal or metal alloy particles being packed in the space 510. After filling and packing the space 510 with metal or metal alloy particles, the upper portion 504 of the mold 500 is placed on the lower portion 502 and the mold 500 placed in a furnace 600 (shown in dashed lines) at a sufficient temperature and for a sufficient time and in a reducing atmosphere or a vacuum for the metal or metal alloy particles to melt and infiltrate the brown unitary structure 218 by being wicked therein. Alternatively, after blocking fluid nozzle ports 518, the space 510 may be pressurized by a suitable fluid source, such as pressurized hydrogen gas, through fluid port 512 to assist infiltration of the metal or metal alloy into the brown unitary structure 218. Additionally, if desired, a vacuum may be applied through fluid port 514 which communicates with the interior space 516 of the brown unitary structure 218 either when the space 510 is not pressurized or is pressurized, to assist infiltration of the metal or metal alloy into the brown unitary structure 218. It is understood that if the space 510 is pressurized and/or the space 516 has a vacuum applied thereto, the upper end of the brown unitary structure 218 will sealingly engage a portion of the upper portion 504 of the mold 500 to prevent any fluid pressure from fluid port 512 leaking into the space 516 or any vacuum applied through fluid port 514 from leaking into the space 510 so that a pressure differential may be maintained across the brown unitary structure 218 from the exterior thereof to the space 516 formed therein. The amount of pressure differential used to assist metal or metal alloy infiltration into brown unitary structure 218 will vary, as it will be determined by various factors, such as the characteristics of the mold 500, the size of the brown unitary structure 218, the temperature used during the infiltration of the brown unitary structure 218, the size of the metal or metal alloy particles used for infiltration of the brown unitary structure 218, the time duration of the infiltration process of the brown unitary structure 218, etc.

Figure 5M:
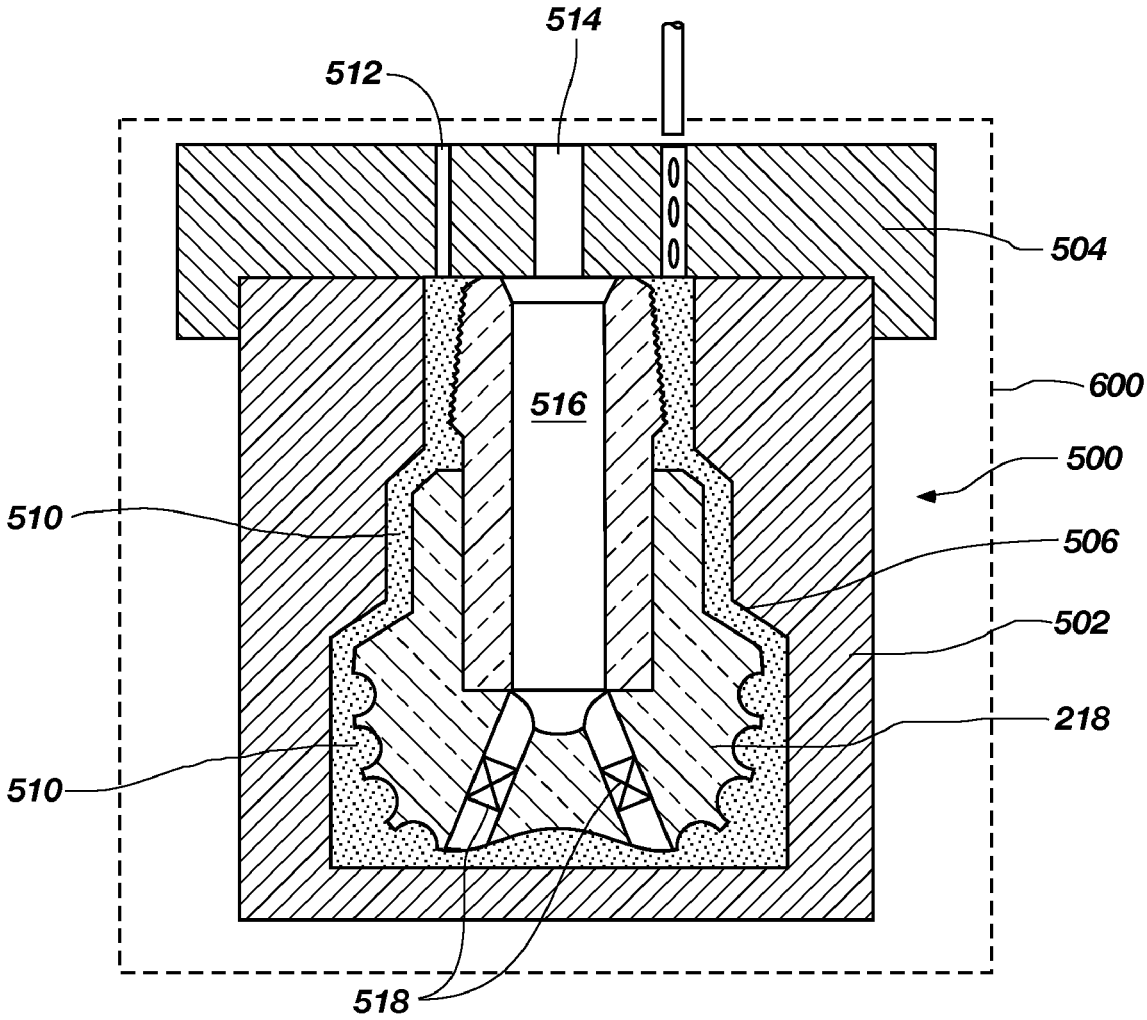

Alternatively, as illustrated in FIG. 5M, the brown unitary structure 218 may be placed in a mold 500 where the upper portion 504 includes a passageway therethrough to the space 510 so that molten infiltrant, such as molten copper alloy, can be flowed into the space 510 in the mold 500 when the mold 500 is in the furnace 600 so that the molten infiltrant can infiltrate the brown unitary structure 218. Alternatively, after blocking fluid nozzle ports 518, the space 510 may be pressurized by a suitable fluid source, such as pressurized hydrogen gas, through fluid port 512 to assist infiltration of the metal or metal alloy into the brown unitary structure 218. Additionally, if desired, a vacuum may be applied through fluid port 514 which communicates with the interior space 516 of the brown unitary structure 218 either when the space 510 is not pressurized or is pressurized, to assist infiltration of the metal or metal alloy into the brown unitary structure 218. It is understood that if the space 510 is pressurized and/or the space 516 has a vacuum applied thereto, the upper end of the brown unitary structure 218 will sealingly engage a portion of the upper portion 504 of the mold 500 to prevent any fluid pressure from fluid port 512 leaking into the space 516 or any vacuum applied through fluid port 514 from leaking into the space 510 so that a pressure differential may be maintained across the brown unitary structure 218 from the exterior thereof to the space 516 formed therein. The amount of pressure differential used to assist metal or metal alloy infiltration into brown unitary structure 218 will vary, as it will be determined by various factors, such as the characteristics of the mold 500, the size of the brown unitary structure 218, the temperature used during the infiltration of the brown unitary structure 218, the size of the metal or metal alloy particles used for infiltration of the brown unitary structure 218, the time duration of the infiltration process of the brown unitary structure 218, etc.

Figure 5N:
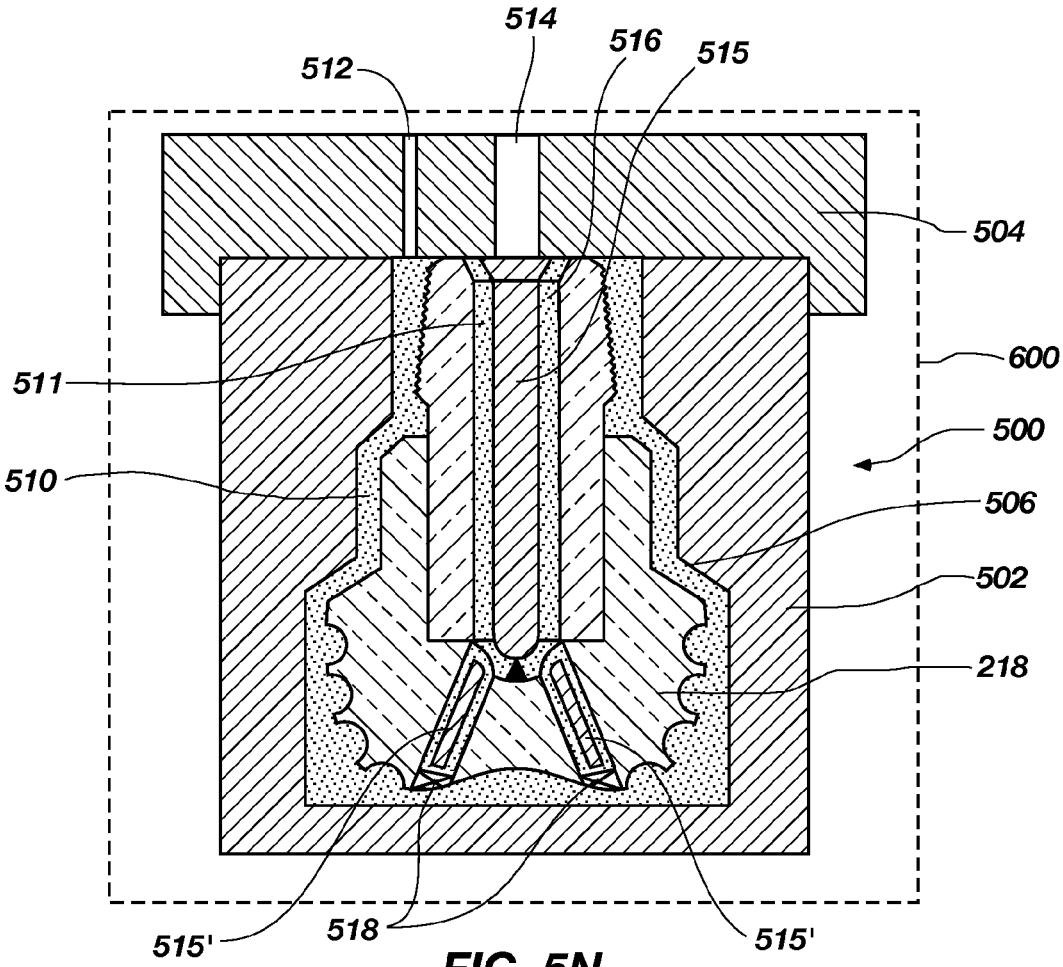

The brown unitary structure 218 as illustrated in FIG. 5N is placed in a mold 500 including a lower portion 502 and an upper portion 504. The lower portion 502 has an interior surface 506 which generally matches the topography of the brown unitary structure 218 therein. The mold 500 is typically machined from a cylindrical graphite element or formed from other heat-resistant material able to withstand the temperatures of an infiltration process. The brown unitary structure 218 has an insert 515 placed in the cavity 516 and inserts 515' placed in fluid nozzle ports 518 being supported from either the bottom of the cavity 516 or the plugs in the fluid nozzle ports 518. After the brown unitary structure 218 is placed in the mold 500, the spaces 510 and 511 between the brown unitary structure 218 and the interior surface 506 of the lower portion 502 and between the insert 515 and the cavity 516 are filled with metal or metal alloy particles to be made molten to infiltrate the brown unitary structure 218. While the volume of the metal or metal alloy particles will vary, initially, approximately a volume of 140% of the theoretical pore-like passage space or interstitial space of the brown unitary structure 218 is placed in the space 510 so that the space 510 is completely filled with metal or metal alloy particles to the top of the brown unitary structure 218 with the metal or metal alloy particles being packed in the space 510. After filling and packing the space 510 with metal or metal alloy particles, the upper portion 504 of the mold 500 is placed on the lower portion 502 and the mold 500 placed in a furnace 600 (shown in dashed lines) at a sufficient temperature and for a sufficient time and in a reducing atmosphere or a vacuum for the metal or metal alloy particles to melt and infiltrate the brown unitary structure 218 by being wicked therein. Alternately, after blocking fluid nozzle ports 518, the space 510 may be pressurized by a suitable fluid source, such as pressurized hydrogen gas, through fluid port 512 to assist infiltration of the metal or metal alloy into the brown unitary structure 218. Additionally, if desired, a vacuum may be applied through fluid port 514 which communicates with the interior space 516 of the brown unitary structure 218 either when the space 510 is not pressurized or is pressurized, to assist infiltration of the metal or metal alloy into the brown unitary structure 218. It is understood that if the space 510 is pressurized and/or the space 516 has a vacuum applied thereto, the upper end of the brown unitary structure 218 will sealingly engage a portion of the upper portion 504 of the mold 500 to prevent any fluid pressure from fluid port 512 leaking into the space 516 or any vacuum applied through fluid port 514 from leaking into the space 510 so that a pressure differential may be maintained across the brown unitary structure 218 from the exterior thereof to the space 516 formed therein. The amount of pressure differential used to assist metal or metal alloy infiltration into brown unitary structure 218 will vary, as it will be determined by various factors, such as the characteristics of the mold 500, the size of the brown unitary structure 218, the temperature used during the infiltration of the brown unitary structure 218, the size of the metal or metal alloy particles used for infiltration of the brown unitary structure 218, the time duration of the infiltration process of the brown unitary structure 218, etc. Since the metal or metal alloy is being infiltrated from both the interior and the exterior of the brown unitary structure 218, the amount of pressure differential used to assist the metal or metal alloy during infiltration must be slight, otherwise, the metal or metal alloy will tend to pool on one side of the brown unitary structure 218.

Figure 5O:
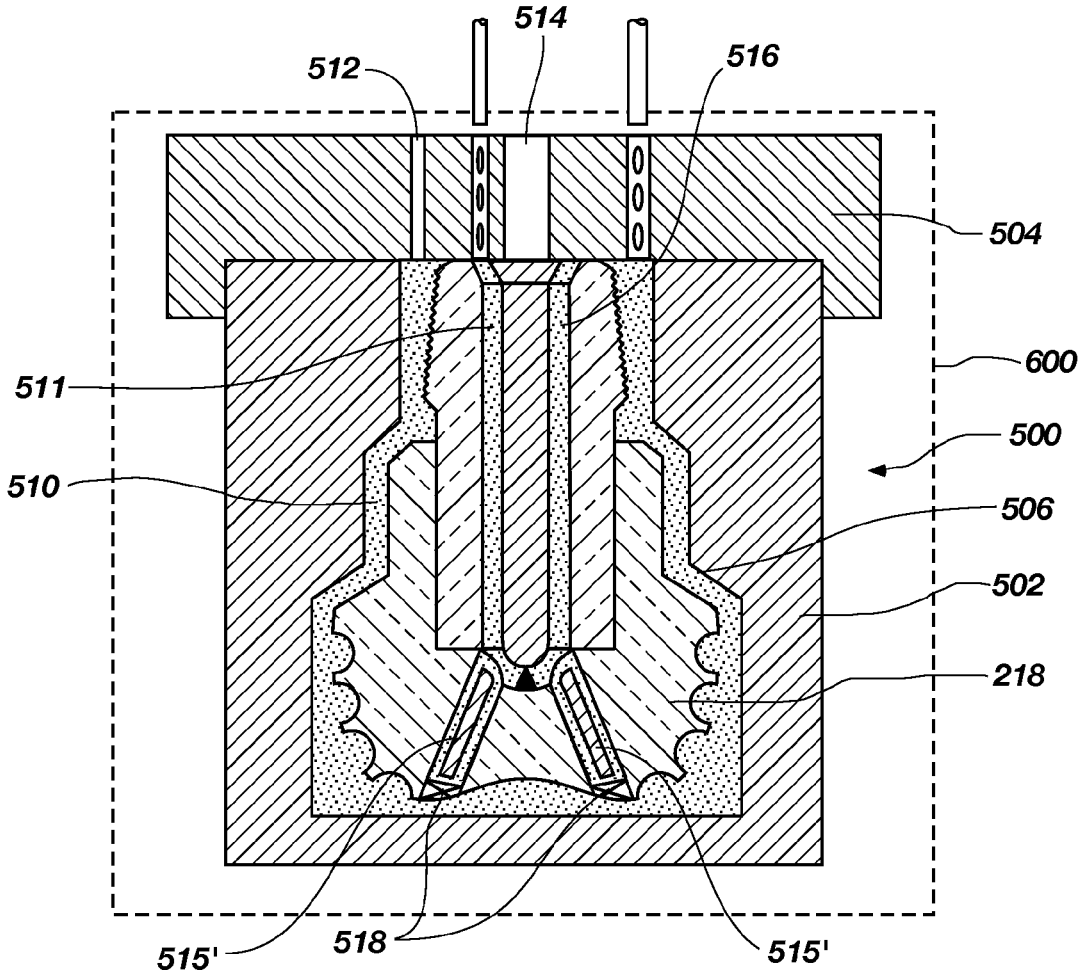

Alternatively, as illustrated in FIG. 5O, the brown unitary structure 218 may be placed in a mold 500 where the upper portion 504 includes passageways therethrough to the spaces 510 and 511 so that molten infiltrant, such as molten copper alloy, can be flowed into the spaces 510 and 511 in the mold 500 when the mold 500 is in the furnace 600 so that the molten infiltrant can infiltrate the brown unitary structure 218. Alternatively, after blocking fluid nozzle ports 518, the space 510 may be pressurized by a suitable fluid source, such as pressurized hydrogen gas, through fluid port 512 to assist infiltration of the metal or metal alloy into the brown unitary structure 218. Additionally, if desired, a vacuum may be applied through fluid port 514 which communicates with the interior space 516 of the brown unitary structure 218 either when the space 510 is not pressurized or is pressurized, to assist infiltration of the metal or metal alloy into the brown unitary structure 218. It is understood that if the space 510 is pressurized and/or the space 516 has a vacuum applied thereto, the upper end of the brown unitary structure 218 will sealingly engage a portion of the upper portion 504 of the mold 500 to prevent any fluid pressure from fluid port 512 leaking into the space 516 or any vacuum applied through fluid port 514 from leaking into the space 510 so that a pressure differential may be maintained across the brown unitary structure 218 from the exterior thereof to the space 516 formed therein. The amount of pressure differential used to assist metal or metal alloy infiltration into brown unitary structure 218 will vary as it will be determined by various factors, such as the characteristics of the mold 500, the size of the brown unitary structure 218, the temperature used during the infiltration of the brown unitary structure 218, the size of the metal or metal alloy particles used for infiltration of the brown unitary structure 218, the time duration of the infiltration process of the brown unitary structure 218, etc. Since the metal or metal alloy is being infiltrated from both the interior and the exterior of the brown unitary structure 218, the amount of pressure differential used to assist the metal or metal alloy during infiltration must be slight, otherwise, the metal or metal alloy will tend to pool on one side of the brown unitary structure 218.

After the brown unitary structure 218 has been infiltrated, the shaped brown unitary structure 218 shown in FIGS. 5L, 5M, 5N, or 5O then may be fully sintered to a desired final density to provide the previously described bit body 152 shown in FIG. 4 and previously described herein. The threaded pin 154 may become bonded and secured to the bit body 152 when the brown unitary structure 218 is sintered to the desired final density. During all sintering and partial sintering processes, refractory structures or displacements (not shown) may be used to support at least a portion of the brown unitary structure 218 during densification to maintain desired shapes and dimensions during the densification process, as previously described.

As any sintering involves densification and removal of porosity within a structure, the structure being sintered will shrink during the sintering process. In an un-infiltrated structure, a structure may experience linear shrinkage of between 10% and 20% during sintering from a green state to a desired final density. As a result, dimensional shrinkage must be considered and accounted for when designing tooling (molds, dies, etc.) or machining features in structures that are less than fully sintered. In an infiltrated structure which is sintered to a desired final density, it is anticipated that the structure may experience a linear shrinkage of approximately 1% or 2%±1% depending upon the amount of closed pore space in the structure which cannot be infiltrated with the metal or metal alloy.

In alternative methods, the shaped green pin 208 shown in FIG. 5H may be inserted into or assembled with the shaped green bit body 178 shown in FIG. 5C to form a green unitary structure. The green unitary structure may be partially sintered to a brown state. The brown unitary structure may then be shaped using conventional machining techniques including, for example, turning techniques, milling techniques, and drilling techniques. The shaped brown unitary structure may then be fully sintered to a desired final density. In yet another alternative method, the shaped brown bit body 186 shown in FIG. 5E may be sintered to a desired final density. The shaped brown threaded pin 216 shown in FIG. 5J may be separately sintered to a desired final density. The fully sintered threaded pin (not shown) may be assembled with the fully sintered bit body (not shown), and the assembled structure may again be heated to sintering temperatures to bond and attach the threaded pin to the bit body.

The sintering processes described above may include any of the subliquidus phase sintering processes previously described herein. For example, the sintering processes described above may be conducted using the Rapid Omnidirectional Compaction (ROC) process, the -CERACON® process, hot isostatic pressing (HIP), or adaptations of such processes, such as have been described herein.

Another method that may be used to form the drill bit 150 shown in FIG. 4 will now be described with reference to FIGS. 6A-6E. The method involves providing multiple powder mixtures having different material compositions at different regions within a mold or container, and simultaneously pressing the various powder mixtures within the container to form a unitary green powder component.

Figure 6A:
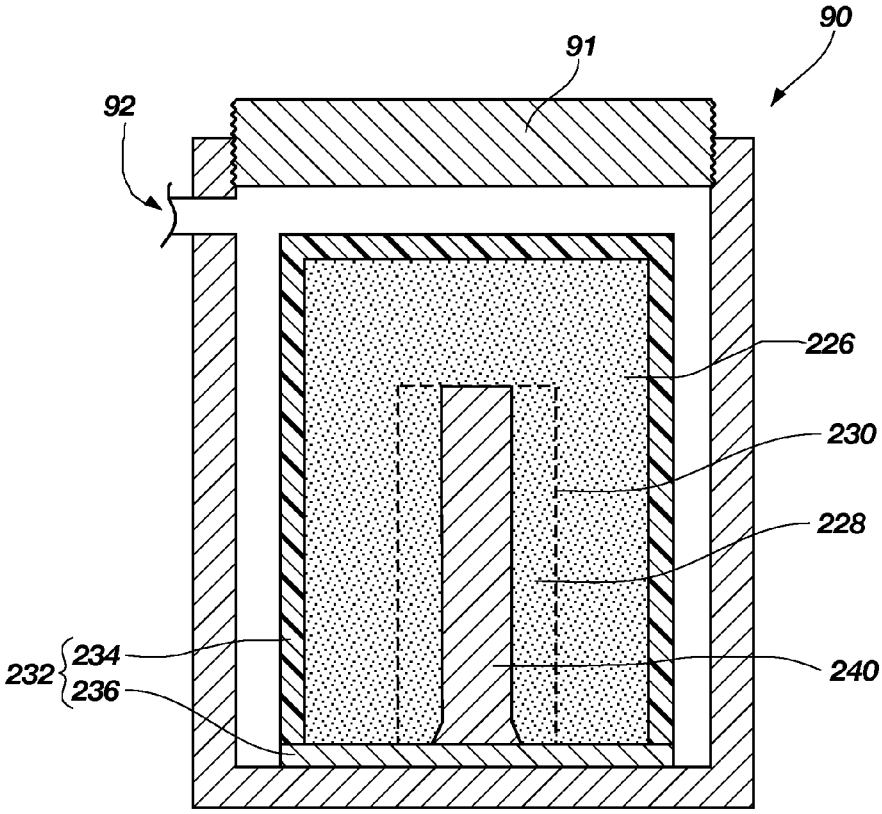
FIGS. 6A-6G illustrate an additional method of forming the earth-boring rotary drill bit shown in FIG. 4.

Referring to FIGS. 6A-6E, the unitary structure 151 (FIG. 4) may be formed in the green state using an isostatic pressing process. As shown in FIG. 6A, a first powder mixture 226 may be provided within a first region of a mold or container 232, and a second powder mixture 228 may be provided within a second region of the container 232. The first region may be loosely defined as the region within the container 232 that is exterior of the phantom line 230, and the second region may be loosely defined as the region within the container 232 that is enclosed by the phantom line 230.

The first powder mixture 226 may include a plurality of hard particles and a plurality of particles comprising a matrix material. The hard particles and the matrix material may be substantially identical to those previously discussed in relation to the drill bit 50 shown in FIG. 2. The second powder mixture 228 may also include a plurality of hard particles and a plurality of particles comprising matrix material, as previously described. The material composition of the second powder mixture 228 may differ, however, from the material composition of the first powder mixture 226. By way of example, the hard particles in the first powder mixture 226 may have a hardness that is higher than a hardness of the hard particles in the second powder mixture 228. Furthermore, the particles of matrix material in the second powder mixture 228 may have a fracture toughness that is higher than a fracture toughness of the particles of matrix material in the first powder mixture 226.

Optionally, each of the first powder mixture 226 and the second powder mixture 228 may further include additives commonly used when pressing powder mixtures such as, for example, binders for providing lubrication during pressing and for providing structural strength to the pressed powder component, plasticizers for making the binder more pliable, and lubricants or compaction aids for reducing inter-particle friction.

The container 232 may include a fluid-tight deformable member 234 and a sealing plate 236. For example, the fluid-tight deformable member 234 may be a substantially cylindrical bag comprising a deformable polymer material. The deformable member 234 may be formed from, for example, an elastomer such as rubber, neoprene, silicone, or polyurethane. The deformable member 234 may be filled with the first powder mixture 226 and the second powder mixture 228. The deformable member 234 and the powder mixtures 226, 228 may be vibrated to provide a uniform distribution of the powder mixtures 226, 228 within the deformable member 234. At least one displacement or insert 240 may be provided within the deformable member 234 for defining features such as, for example, the longitudinal bore 40 (FIG. 4). Alternatively, the insert 240 may not be used and the longitudinal bore 40 may be formed using a conventional machining process during subsequent processes. The sealing plate 236 then may be attached or bonded to the deformable member 234 providing a fluid-tight seal therebetween.

The container 232 (with the first powder mixture 226, the second powder mixture 228, and any desired inserts 240 contained therein) may be provided within a pressure chamber 90. A removable cover 91 may be used to provide access to the interior of the pressure chamber 90. A fluid (which may be substantially incompressible) such as, for example, water, oil, or gas (such as, for example, air or nitrogen) is pumped into the pressure chamber 90 through an opening 92 using a pump (not shown). The high pressure of the fluid causes the walls of the deformable member 234 to deform. The pressure may be transmitted substantially uniformly to the first powder mixture 226 and the second powder mixture 228. The pressure within the pressure chamber 90 during isostatic pressing may be greater than about 35 megapascals (about 5,000 pounds per square inch). More particularly, the pressure within the pressure chamber 90 during isostatic pressing may be greater than about 138 megapascal (20,000 pounds per square inch). In alternative methods, a vacuum may be provided within the container 232 and a pressure greater than about 0.1 megapascal (about 15 pounds per square inch) may be applied to the exterior surfaces of the container 232 (by, for example, the atmosphere) to compact the first powder mixture 226 and the second powder mixture 228. Isostatic pressing of the first powder mixture 226 together with the second powder mixture 228 may form a green powder component or green unitary structure 244 shown in FIG. 6B, which can be removed from the pressure chamber 90 and container 232 after pressing.

Figure 6B:
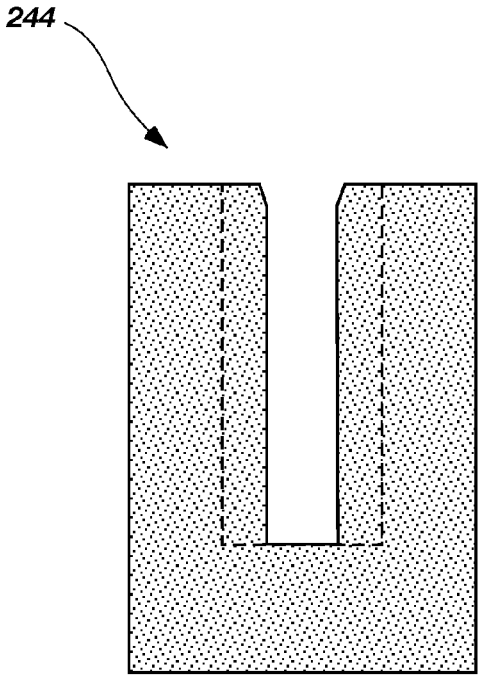

In an alternative method of pressing the powder mixtures 226,228 to form the green unitary structure 244 shown in FIG. 6B, the powder mixtures 226, 228 may be uniaxially pressed in a mold or die (not shown) using a mechanically or hydraulically actuated plunger by methods that are known to those of ordinary skill in the art of powder processing.

The green unitary structure 244 shown in FIG. 6B may include a plurality of particles held together by binder materials provided in the powder mixtures 226, 228 (FIG. 6A). Certain structural features may be machined in the green unitary structure 244 using conventional machining techniques including, for example, turning techniques, milling techniques, and drilling techniques. Hand held tools also may be used to manually form or shape features in or on the green unitary structure 244.

Figure 6C:
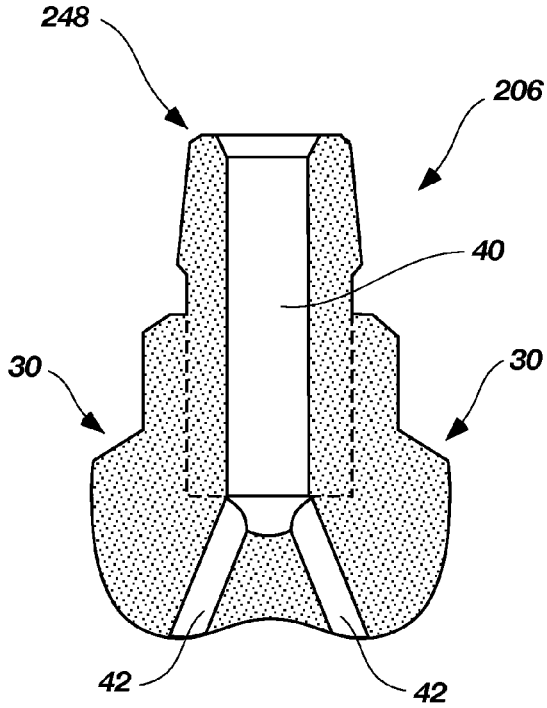

By way of example and not limitation, blades 30, junk slots 32 (FIG. 4), internal fluid passageways 42, and a tapered surface 206 may be formed in the green unitary structure 244 to form a shaped green unitary structure 248 shown in FIG. 6C.

Figure 6D:
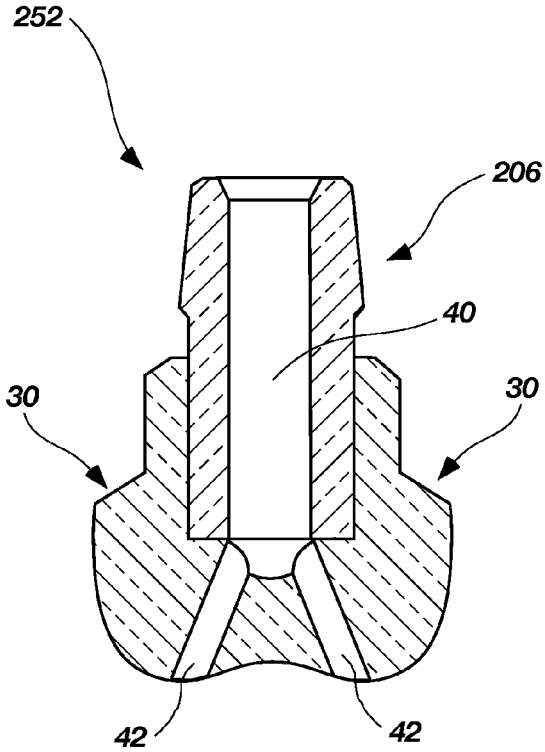

The shaped green unitary structure 248 shown in FIG. 6C may be at least partially sintered to provide a brown unitary structure 252 shown in FIG. 6D, which has less than a desired final density. Prior to at least partially sintering the shaped green unitary structure 248, the shaped green unitary structure 248 may be subjected to elevated temperatures to burn off or remove any fugitive additives that were included in the first powder mixture 226 or the second powder mixture 228 (FIG. 6A) as previously described. Furthermore, the shaped green unitary structure 248 may be subjected to a suitable atmosphere tailored to aid in the removal of such additives. Such atmospheres may include, for example, hydrogen gas at temperatures of about 500° C.

The brown unitary structure 252 may be substantially machinable due to the remaining porosity therein. Certain structural features may be machined in the brown unitary structure 252 using conventional machining techniques including, for example, turning techniques, milling techniques, and drilling techniques. Hand held tools also may be used to manually form or shape features in or on the brown unitary structure 252. Furthermore, cutting tools that include super hard coatings or inserts may be used to facilitate machining of the brown unitary structure 252. Additionally, coatings may be applied to the brown unitary structure 252 prior to machining to reduce chipping of the brown unitary structure 252. Such coatings may include a fixative or other polymer material.

Figure 6E:
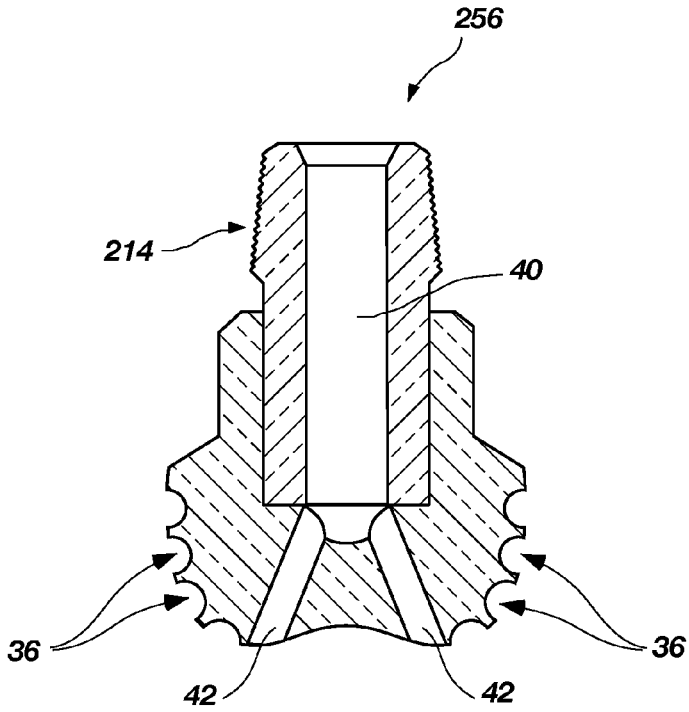

By way of example and not limitation, cutter pockets 36, buttresses 38 (FIG. 4), and threads 214 may be formed in the brown unitary structure 252 to form a shaped brown unitary structure 256 shown in FIG. 6E. Furthermore, if the drill bit 150 (FIG. 4) is to include a plurality of cutters integrally formed with the bit body 152, the cutters may be positioned within the cutter pockets 36 formed in the shaped brown unitary structure 256. Upon subsequent sintering of the shaped brown unitary structure 256, the cutters may become bonded to and integrally formed with the bit body 152 (FIG. 4).

Figure 6F:
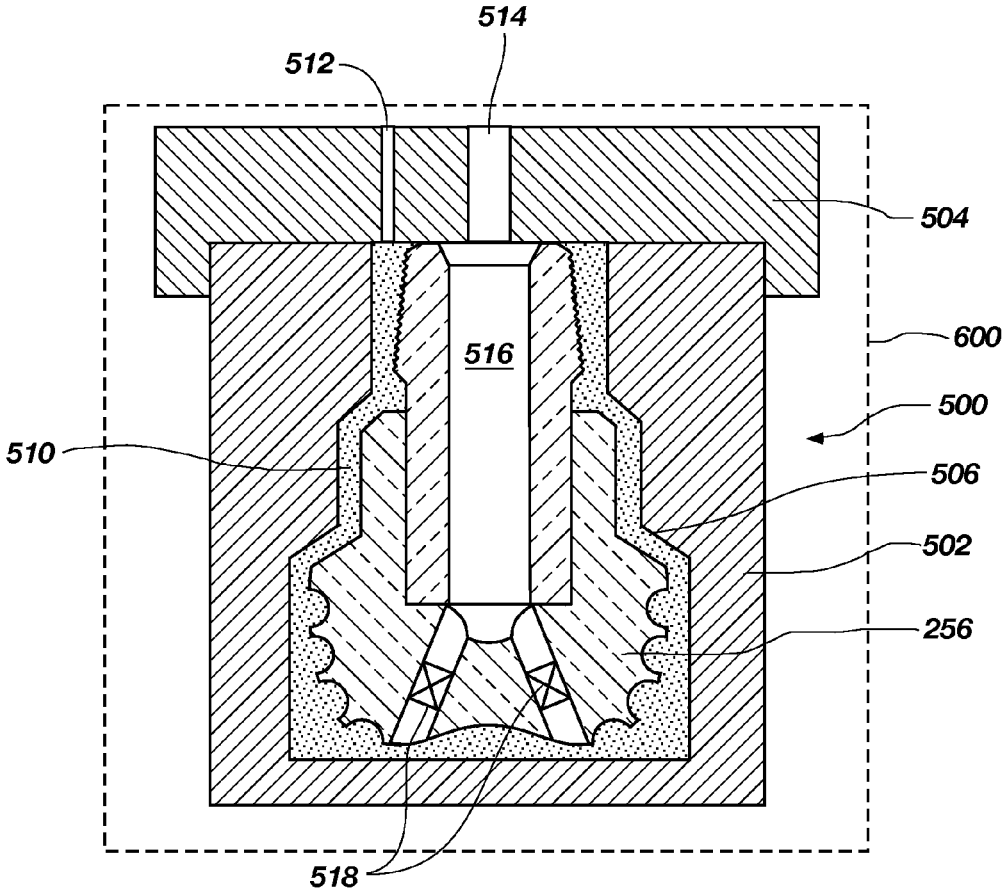

The brown unitary structure (e.g., the brown bit body 256) as illustrated in FIG. 6F is placed in a mold 500 including a lower portion 502 and an upper portion 504. The lower portion 502 has an interior surface 506 which generally matches the topography of the brown bit body 256 therein. The mold 500 is typically machined from a cylindrical graphite element or formed from other heat-resistant material able to withstand the temperatures of an infiltration process. After the brown bit body 256 is placed in the mold 500, the space 510 between the brown bit body 256 and the interior surface 506 of the lower portion 502 is filled with metal or metal alloy particles to be made molten to infiltrate the brown bit body 256. While the volume of the metal or metal alloy particles will vary, initially, approximately a volume of 140% of the theoretical pore-like passage space or interstitial space of the brown bit body 256 is placed in the space 510 so that the space 510 is completely filled with metal or metal alloy particles to the top of the brown bit body 256 with the metal or metal alloy particles being packed in the space 510. After filling and packing the space 510 with metal or metal alloy particles (or metal or metal alloy foil, etc.), the upper portion 504 of the mold 500 is placed on the lower portion 502 and the mold 500 placed in a furnace 600 (shown in dashed lines) at a sufficient temperature and as sufficient time and in a reducing atmosphere or a vacuum for the metal or metal alloy particles to melt and infiltrate the brown bit body 256 by being wicked therein. Alternatively, after blocking fluid nozzle ports 518, the space 510 may be pressurized by a suitable fluid source, such as pressurized hydrogen gas, through fluid port 512 to assist infiltration of the metal or metal alloy into the brown bit body 256. Additionally, if desired, a vacuum may be applied through fluid port 514 which communicates with the interior space 516 of the brown bit body 256 either when the space 510 is not pressurized or is pressurized, to assist infiltration of the metal or metal alloy into the brown bit body 256. It is understood that if the space 510 is pressurized and/or the space 516 has a vacuum applied thereto, the upper end of the brown bit body 256 will sealingly engage a portion of the upper portion 504 of the mold 500 to prevent any fluid pressure from fluid port 512 leaking into the space or cavity 516 or any vacuum applied through fluid port 514 from leaking into the space 510 so that a pressure differential may be maintained across the brown bit body 256 from the exterior thereof to the space or cavity 516 formed therein. The amount of pressure differential used to assist metal or metal alloy infiltration into brown bit body 256 will vary, as it will be determined by various factors, such as the characteristics of the mold 500, the size of the brown bit body 256, the temperature used during the infiltration of the brown bit body 256, the size of the metal or metal alloy particles used for infiltration of the brown bit body 102, average pore size of the pores in the brown bit body 256, the time duration of the infiltration process of the brown bit body 256, etc.

Figure 6G:
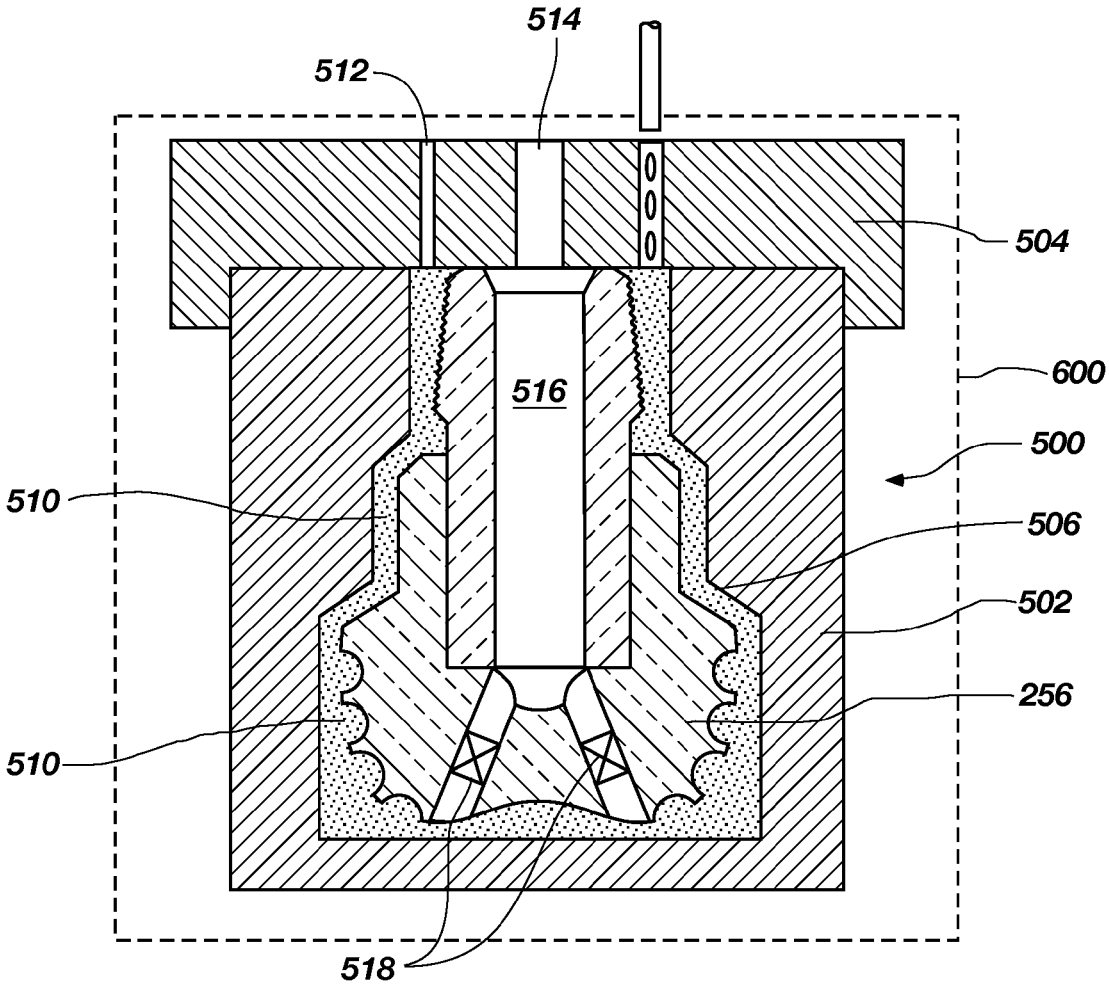

Alternatively, as illustrated in FIG. 6G, the brown bit body 256 may be placed in a mold 500 where the upper portion 504 includes a passageway therethrough to the space 510 so that molten infiltrant, such as molten copper alloy, can be flowed into the space 510 in the mold 500 when the mold 500 is in the furnace 600 so that the molten infiltrant can infiltrate the brown bit body 256. Alternatively, after blocking the fluid nozzle ports 518, the space 510 may be pressurized by a suitable fluid source, such as pressurized hydrogen gas, through fluid port 512 to assist infiltration of the metal or metal alloy into the brown bit body 256. Additionally, if desired, a vacuum may be applied through fluid port 514 which communicates with the interior space 516 of the brown bit body 256 either when the space 510 is not pressurized or is pressurized, to assist infiltration of the metal or metal alloy into the brown bit body 256. It is understood that if the space 510 is pressurized and/or the space 516 has a vacuum applied thereto, the upper end of the brown bit body 256 will sealingly engage a portion of the upper portion 504 of the mold 500 to prevent any fluid pressure from fluid port 512 leaking into the space 516 or any vacuum applied through fluid port 514 from leaking into the space 510 so that a pressure differential may be maintained across the brown bit body 256 from the exterior thereof to the space 516 formed therein. The amount of pressure differential used to assist metal or metal alloy infiltration into brown bit body 256 will vary as it will be determined by various factors, such as the characteristics of the mold 500, the size of the brown bit body 256, the temperature used during the infiltration of the brown bit body 256, the size of the metal or metal alloy particles used for infiltration of the brown bit body 256, the time duration of the infiltration process of the brown bit body 256, etc.

After the brown bit body 256 has been infiltrated, the shaped brown bit body 256 shown in FIG. 6F or 6G then may be fully sintered to a desired final density to provide the previously described bit body 152 shown in FIG. 4 and previously described herein. The threaded pin 154 may become bonded and secured to the bit body 152 when the unitary structure is sintered to the desired final density. During all sintering and partial sintering processes, refractory structures or displacements (not shown) may be used to support at least a portion of the unitary structure during densification to maintain desired shapes and dimensions during the densification process, as previously described. The refractory structures or displacements also may be used to hold the infiltrant material in place during the sintering and partial sintering processes.

As any sintering involves densification and removal of porosity within a structure, the structure being sintered will shrink during the sintering process. In an un-infiltrated structure, a structure may experience linear shrinkage of between 10% and 20% during sintering from a green state to a desired final density. As a result, dimensional shrinkage must be considered and accounted for when designing tooling (molds, dies, etc.) or machining features in structures that are less than fully sintered. In an infiltrated structure which is sintered to a desired final density, it is anticipated that the structure may experience a linear shrinkage of approximately 1% or 2%±1% depending upon the amount of pore space in the structure which cannot be infiltrated with the metal or metal alloy.

During all sintering and partial sintering processes, refractory structures or displacements (not shown) may be used to support at least a portion of the bit body during densification to maintain desired shapes and dimensions during the densification process. Such displacements may be used, for example, to maintain consistency in the size and geometry of the cutter pockets 36 and the internal fluid passageways 42 during sintering and densification. Such refractory structures may be formed from, for example, graphite, silica, or alumina. The use of alumina displacements instead of graphite displacements may be desirable as alumina may be relatively less reactive than graphite, thereby minimizing atomic diffusion during sintering. Additionally, coatings such as alumina, boron nitride, aluminum nitride, or other commercially available materials may be applied to the refractory structures to prevent carbon or other atoms in the refractory structures from diffusing into the bit body during densification.

Furthermore, any of the previously described sintering methods may be used to sinter the shaped brown unitary structure 256 shown in FIG. 6E to the desired final density.

In the previously described method, features of the unitary structure 151 were formed by shaping or machining both the green unitary structure 244 shown in FIG. 6B and the brown unitary structure 252 shown in FIG. 6D. Alternatively, all shaping and machining may be conducted on either a green unitary structure or a brown unitary structure. For example, the green unitary structure 244 shown in FIG. 6B may be partially sintered to form a brown unitary structure (not shown) without performing any shaping or machining of the green unitary structure 244. Substantially all features of the unitary structure 151 (FIG. 4) may be formed in the brown unitary structure, prior to sintering the brown unitary structure to a desired final density. Alternatively, substantially all features of the unitary structure 151 (FIG. 4) may be shaped or machined in the green unitary structure 244 shown in FIG. 6B. The fully shaped and machined green unitary structure (not shown) may then be sintered to a desired final density.

Figure 7:
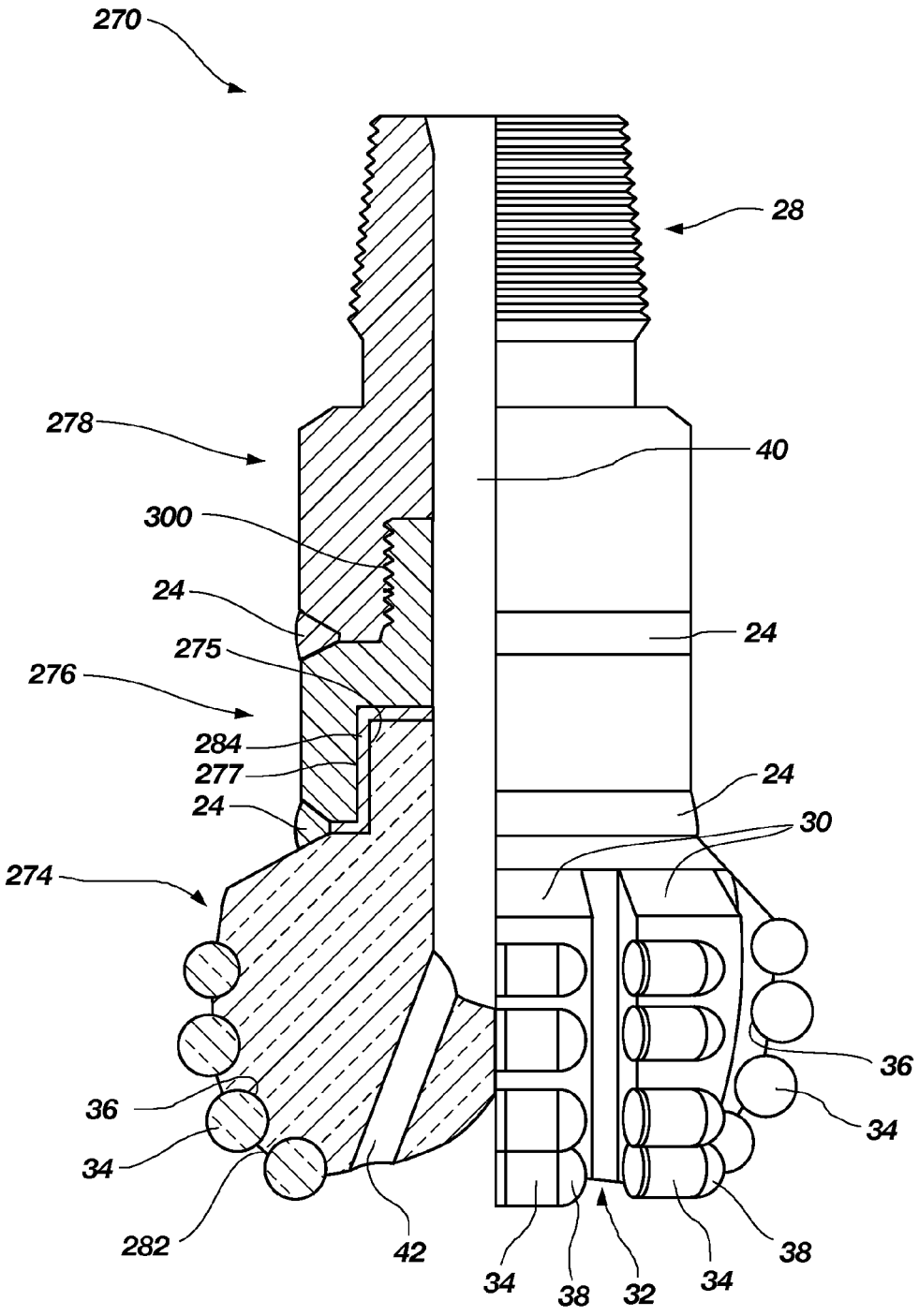
FIG. 7 is a partial cross-sectional side view of yet another earth-boring rotary drill bit that embodies teachings of the present invention and has a bit body that includes a particle-matrix composite material.

An earth-boring rotary drill bit 270 that embodies teachings of the present invention is shown in FIG. 7. The drill bit 270 includes a bit body 274 substantially formed from and composed of a particle-matrix composite material. The drill bit 270 also may include an extension 276 comprising a metal or metal alloy and a shank 278 attached to the bit body 274. By way of example and not limitation, the extension 276 and the shank 278 each may include steel or any other iron-based alloy. The shank 278 may include an API threaded pin 28 for connecting the drill bit 270 to a drill string (not shown).

The bit body 274 may include blades 30, which are separated by junk slots 32. Internal fluid passageways 42 may extend between the face 282 of the bit body 274 and a longitudinal bore 40, which extends through the shank 278, the extension 276, and partially through the bit body 274. Nozzle inserts (not shown) may be provided at face 282 of the bit body 274 within the internal fluid passageways 42.

The drill bit 270 may include a plurality of PDC cutters 34 disposed on the face 282 of the bit body 274. The PDC cutters 34 may be provided along blades 30 within pockets 36 formed in the face 282 of the drill bit 270, and may be supported from behind by buttresses 38, which may be integrally formed with the bit body 274. Alternatively, the drill bit 270 may include a plurality of cutters each comprising a wear-resistant abrasive material, such as, for example, a particle-matrix composite material. The particle-matrix composite material of the cutters may have a different composition from the particle-matrix composite material of the bit body 274. Furthermore, such cutters may be integrally formed with the bit body 274.

The particle-matrix composite material of the bit body 274 may include a plurality of hard particles randomly dispersed throughout a matrix material. The hard particles and the matrix material may be substantially identical to those previously discussed in relation to the drill bit 50 shown in FIG. 2.

In one embodiment of the present invention, the particle-matrix composite material of the bit body 274 may include a plurality of tungsten carbide particles having an average diameter in a range from about 0.5 micron to about 20 microns. The matrix material may include cobalt- and nickel-based metal alloy. The tungsten carbide particles may comprise between about 60% and about 95% by weight of the particle-matrix composite material, and the matrix material may comprise between about 5% and about 40% by weight of the particle-matrix composite material. The pore-like passageways of the bit body 274 being substantially filled with a suitable metal or metal alloy as described hereinbefore.

The bit body 274 is substantially similar to the bit body 52 shown in FIG. 2, and may be formed by any of the methods previously discussed herein in relation to FIGS. 3A-3E.

In conventional drill bits that have a bit body that includes a particle-matrix composite material, a preformed steel blank is used to attach the bit body to a steel shank. The preformed steel blank is attached to the bit body when particulate carbide material is infiltrated by molten matrix material within a mold and the matrix material is allowed to cool and solidify, as previously discussed. Threads or other features for attaching the steel blank to the steel shank can then be machined in surfaces of the steel blank.

As the bit body 274 is formed using sintering and infiltration techniques, a preformed steel blank may be attached with the bit body 274 as described herein. As an alternative method for attaching the shank 278 to the bit body 274, an extension 276 may be attached to the bit body 274 after formation of the bit body 274.

The extension 276 may be attached and secured to the bit body 274 by, for example, brazing or soldering an interface between a surface 275 of the bit body 274 and a surface 277 of the extension 276. For example, the interface between the surface 275 of the bit body 274 and the surface 277 of the extension 276 may be brazed using a furnace brazing process or a torch brazing process. The bit body 274 and the extension 276 may be sized and configured to provide a predetermined standoff between the surface 275 and the surface 277, in which a brazing alloy 284 may be provided. The brazing alloy 284 may include, for example, a silver-based or a nickel-based alloy.

Additional cooperating non-planar surface features (not shown) may be formed on or in the surface 275 of the bit body 274 and an abutting surface 277 of the extension 276 such as, for example, threads or generally longitudinally-oriented keys, rods, or splines, which may prevent rotation of the bit body 274 relative to the extension 276.

In alternative embodiments, a press fit or a shrink fit may be used to attach the extension 276 to the bit body 274. To provide a shrink fit between the extension 276 and the bit body 274, a temperature differential may be provided between the extension 276 and the bit body 274. By way of example and not limitation, the extension 276 may be heated to cause thermal expansion of the extension 276 while the bit body 274 may be cooled to cause thermal contraction of the bit body 274. The extension 276 then may be pressed onto the bit body 274 and the temperatures of the extension 276 and the bit body 274 may be allowed to equilibrate. As the temperatures of the extension 276 and the bit body 274 equilibrate, the surface 277 of the extension 276 may engage or abut against the surface 275 of the bit body 274, thereby at least partly securing the bit body 274 to the extension 276 and preventing separation of the bit body 274 from the extension 276.

Alternatively, a friction weld may be provided between the bit body 274 and the extension 276. Abutting surfaces may be provided on the extension 276 and the bit body 274. A machine may be used to press the extension 276 against the bit body 274 while rotating the bit body 274 relative to the extension 276. Heat generated by friction between the extension 276 and the bit body 274 may at least partially melt the material at the mating surfaces of the extension 276 and the bit body 274. The relative rotation may be stopped and the bit body 274 and the extension 276 may be allowed to cool while maintaining axial compression between the bit body 274 and the extension 276, providing a friction welded interface between the mating surfaces of the extension 276 and the bit body 274.

Additionally, a weld 24 may be provided between the bit body 274 and the extension 276 that extends around the drill bit 270 on an exterior surface thereof along an interface between the bit body 274 and the extension 276. A shielded metal arc welding (SMAW) process, a gas metal arc welding (GMAW) process, a plasma transferred arc (PTA) welding process, a submerged arc welding process, an electron beam welding process, or a laser beam welding process may be used to weld the interface between the bit body 274 and the extension 276.

After the extension 276 has been attached and secured to the bit body 274, the shank 278 may be attached to the extension 276. By way of example and not limitation, positioning threads 300 may be machined in abutting surfaces of the steel shank 278 and the extension 276. The steel shank 278 then may be threaded onto the extension 276. A weld 24 then may be provided between the steel shank 278 and the extension 276 that extends around the drill bit 270 on an exterior surface thereof along an interface between the steel shank 278 and the extension 276. Furthermore, solder material or brazing material may be provided between abutting surfaces of the steel shank 278 and the extension 276 to further secure the steel shank 278 to the extension 276.

By attaching an extension 276 to the bit body 274, removal and replacement of the steel shank 278 may be facilitated relative to removal and replacement of shanks that are directly attached to a bit body substantially formed from and composed of a particle-matrix composite material, such as, for example, the shank 70 of the drill bit 50 shown in FIG. 2.

While teachings of the present invention are described herein in relation to embodiments of earth-boring rotary drill bits that include fixed cutters, other types of earth-boring drilling tools such as, for example, core bits, eccentric bits, bicenter bits, reamers, mills, drag bits, roller cone bits, and other such structures known in the art may embody teachings of the present invention and may be formed by methods that embody teachings of the present invention.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors. Further, the invention has utility in drill bits and core bits having different and various bit profiles as well as cutter types.

What is claimed is:

1. A method of forming an earth-boring rotary drill bit, the method comprising:

providing a first powder mixture comprising a plurality of hard particles and a plurality of particles comprising a matrix material within a region of a container configured to form a bit body;

providing a second powder mixture comprising a plurality of hard particles and a plurality of particles comprising a matrix material exhibiting a different material composition than a material composition of the first powder mixture within another region of the container configured to form a pin;

pressing the first and second powder mixtures within the container to form a green unitary structure;

machining a tapered surface into a portion of the green unitary structure comprising the second powder mixture;

partially sintering the green unitary structure to form a brown unitary structure;

machining threads into the tapered surface of the brown unitary structure-, placing the brown unitary structure in a mold;

at least substantially filling a space defined between the brown unitary structure and the mold with metal or metal alloy particles; and infiltrating the brown unitary structure with a metal or a metal alloy by melting the metal or metal alloy particles to form the earth-boring rotary drill bit comprising the bit body and the pin secured to and integrally formed with the bit body.

2. The method of claim 1, wherein the providing the second powder mixture comprises selecting the plurality of hard particles of the second powder mixture to comprise a material selected from the group consisting of diamond, boron carbide, boron nitride, aluminum nitride, and carbides or borides of the group consisting of W, Ti, Mo, Nb, V, Hf, Zr, and Cr.

3. The method of claim 1, wherein the pressing the first and second powder mixtures comprises isostatically pressing the first and second powder mixtures.

4. The method of claim 1, further comprising sintering the earth-boring rotary drill bit to a final density after infiltrating the brown unitary structure.

5. The method of claim 4, wherein the sintering the earth-boring rotary drill bit to the final density comprises:

hot isostatic pressing the earth-boring rotary drill bit.

6. The method of claim 1, wherein the infiltrating the brown unitary structure with the metal or the metal alloy comprises infiltrating the brown unitary structure with a metal or a metal alloy comprising copper.

7. The method of claim 1, wherein the infiltrating the brown unitary structure by melting the metal or metal alloy particles comprises infiltrating the brown unitary structure by wicking melted metal or metal alloy particles into the brown unitary structure.

8. The method of claim 1, wherein the pressing the first and second powder mixtures within the container comprises uniaxially pressing the first and second powder mixtures within the container.

9. The method of claim 1, wherein the pressing the first and second powder mixtures within the container comprises applying a pressure greater than 35 MPa to the first and second powder mixtures.

10. The method of claim 1, further comprising:

applying a vacuum while infiltrating the brown unitary structure.

11. The method of claim 1, wherein the infiltrating the brown unitary structure comprises infiltrating the brown unitary structure from an exterior of the brown unitary structure.

12. The method of claim 11, wherein the at least substantially filling the space defined between the brown unitary structure and the mold with the metal or metal alloy particles comprises:

at least substantially filling the space defined between the exterior of the brown unitary structure and the mold with the metal or metal alloy particles.

13. The method of claim 1, wherein the infiltrating the brown unitary structure comprises infiltrating the brown unitary structure from an interior of the brown unitary structure.

14. The method of claim 13, wherein the brown unitary structure comprises an interior cavity defined within the brown unitary structure and wherein the at least substantially filling the space defined between the brown unitary structure and the mold with the metal or metal alloy particles comprises:

at least substantially filling the space defined between the interior cavity of the brown unitary structure and the mold with the metal or metal alloy particles.

15. The method of claim 1, wherein the infiltrating the brown unitary structure comprises infiltrating the brown unitary structure from an exterior and an interior of the brown unitary structure.

16. The method of claim 1, wherein the providing the first and second powder mixtures within the container comprises providing the first and second powder mixtures within a container comprising a deformable member.

17. The method of claim 1, wherein the infiltrating the brown unitary structure further comprises:

flowing one of a liquid metal and a liquid metal alloy into the space between the brown unitary structure and the mold.

18. The method of claim 1, further comprising:

providing at least one additive selected from the group consisting of a binder, a plasticizer, a lubricant, and a compaction aid in the container before pressing the first and second powder mixtures.

19. The method of claim 1, wherein the placing the brown unitary structure in the mold comprises sealingly engaging an upper portion of the mold with an upper end of the brown unitary structure.

* * * * *

UNITED STATES PATENT AND TRADEMARK OFFICE

CERTIFICATE OF CORRECTION

PATENT NO. : 8,261,632 B2
APPLICATION NO. : 12/169820
DATED : September 11, 2012
INVENTOR(S) : John H. Stevens It is certified that error appears in the above-identified patent and that said Letters Patent is hereby corrected as shown below:

In the specification:

| | | |
|---|---|---|
| COLUMN 1, | LINE 12, | change "And Methods Of" to --and Methods of-- |
| COLUMN 1, | LINE 21, | change "Bodies", assigned" to --Bodies," each of which is assigned-- |
| COLUMN 13, | LINE 63, | change "includes a passageways" to --includes passageways-- |
| COLUMN 24, | LINE 41, | change "Alternately," to --Alternatively,-- |
| COLUMN 29, | LINE 27, | change "body **102**," to --body **256**,-- |

In the claims:

| | | | |
|---|---|---|---|
| CLAIM 1, | COLUMN 33, | LINE 42, | change "structure-;" to --structure;-- |

Signed and Sealed this
Fifteenth Day of December, 2015

Michelle K. Lee

Michelle K. Lee
*Director of the United States Patent and Trademark Office*